US006688843B2

(12) United States Patent
Saeki

(10) Patent No.: US 6,688,843 B2
(45) Date of Patent: Feb. 10, 2004

(54) ONCE-THROUGH PUMP

(75) Inventor: Naofumi Saeki, Ibaraki (JP)

(73) Assignee: Calsonic Kansei Corporation, Tokyo (JP)

( * ) Notice: Subject to any disclaimer, the term of this patent is extended or adjusted under 35 U.S.C. 154(b) by 6 days.

(21) Appl. No.: 10/033,892

(22) Filed: Jan. 3, 2002

(65) Prior Publication Data

US 2002/0090291 A1 Jul. 11, 2002

(30) Foreign Application Priority Data

Jan. 9, 2001 (JP) ..... 2001-001625
Jun. 26, 2001 (JP) ..... 2001-192526

(51) Int. Cl.[7] ..... F04D 5/00

(52) U.S. Cl. ..... 415/5; 415/53.1; 416/7; 417/320

(58) Field of Search ..... 415/5, 6, 52.1, 415/53.1, 53.2; 416/7, 170 R, 178, 187; 417/320

(56) References Cited

U.S. PATENT DOCUMENTS 3,270,805 A * 9/1966 Glucksman ..... 415/5 X

* cited by examiner

*Primary Examiner*—Edward K. Look
*Assistant Examiner*—Richard A. Edgar
(74) *Attorney, Agent, or Firm*—Sughrue Mion, PLLC

(57) ABSTRACT

A once-through pump is provided which is able to improve air-blowing efficiency, reduce operation noise, and achieve a sufficient amount of blast or flow rate even within a limited design space. The once-through pump for accelerating fluid (F) in a flow passage (P) while passing the fluid (F) through the flow passage (P) includes a cylindrical impeller (10) rotatably supported in the flow passage, a plurality of vanes (11) provided on the outer periphery of the impeller (10), and a motor for driving the impeller to rotate. The impeller (10) has a substantially D-shaped cross sectional configuration with a suction side, at which the fluid (F) is sucked into the impeller (10), being formed into a straight portion (10*a*). Each of the vanes (11) has a positive vane angle with respect to a fluid advancing or flowing direction (A) in the straight portion (10*a*).

10 Claims, 14 Drawing Sheets

FIG. 6
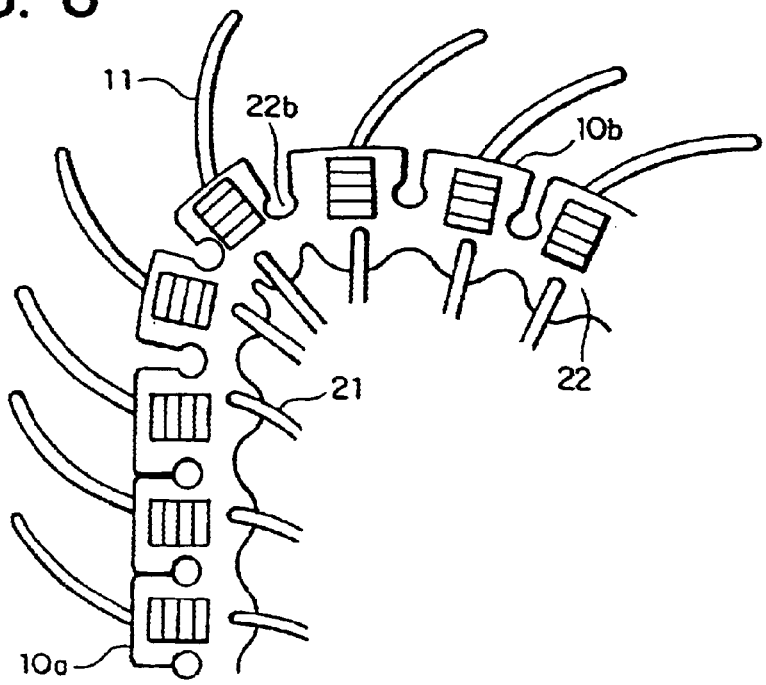
FIG. 7B
FIG. 7A
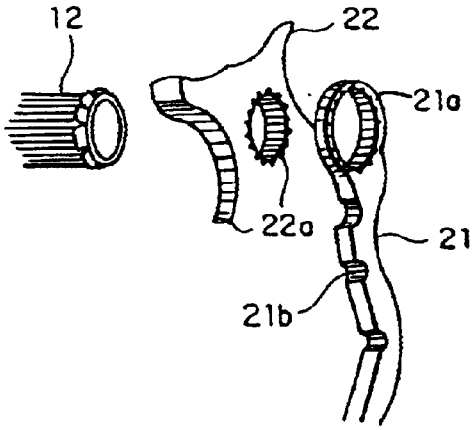
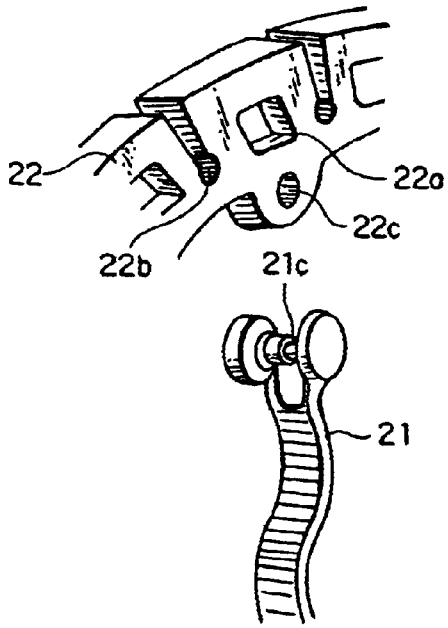

ONCE-THROUGH PUMP

This application is based on Application Ser. Nos. 2001001625 and 2001192526, filed in Japan on Jan. 9, 2001 and Jun. 26, 2001, the contents of which are hereby incorporated by reference.

BACKGROUND OF THE INVENTION

1. Field of the Invention

The present invention relates to a once-through pump (e.g., once-through blower) which is adapted to be incorporated in a domestic air conditioner, an automotive air conditioner, etc., for accelerating fluid in a flow passage while passing therethrough, and more specifically, it relates to a once-through pump which is capable of improving the pumping (or air-blowing) efficiency to thereby reduce noise in operation and achieve a sufficient pumping flow rate as well even within a limited design space.

2. Description of the Related Art

FIG. 25 is a cross sectional side view schematically illustrating a known once-through pump such as, for example, a once-through blower.

FIG. 26 is an enlarged cross sectional view illustrating the operation of fluid F in the vicinity of an impeller 100 in FIG. 25.

In FIG. 25, a heat exchanger 1 of an air conditioner is arranged on the upstream side of a flow passage P such as a channel, duct, etc., through which the fluid F such as air (see an arrow) passes.

The impeller 100 of a cylindrical shape, which constitutes the main body of the once-through blower, is integrally formed of a resin or the like, and is rotatably supported within the flow passage P.

The impeller 100 is driven to rotate around a rotation shaft or drive shaft 200 by the driving force of an unillustrated motor in a direction of arrow B.

The impeller 100 is provided on the outer periphery thereof with a multitude of vanes 101 (an array of vanes) at equal intervals in a symmetric relation with respect to the drive shaft 200.

Moreover, a tongue portion 2 is formed on the inner wall of the flow passage P for providing a cutoff structure, so that a portion of the flow passage P on the outer periphery of the impeller 100 is made into a bent or curved configuration about the tongue portion 2.

As a result, the fluid F in the impeller 100 generates a swirl or vortex E (see a clockwise arrow in FIG. 26) at a part near the tip of the tongue portion 2, as illustrated in FIG. 26, whereby the fluid F is accelerated while passing between adjacent ones of the rotating vanes 101.

That is, the fluid F located on the upstream side of the impeller 100 is sucked into the impeller 100 under a negative pressure of the vortex E, and discharged toward the downstream side of the impeller 100 while being accelerated by the centrifugal force of the impeller 100 acting in a rotational direction B.

In general, the once-through blower comprising the impeller 100 illustrated in FIG. 25 and FIG. 26 has a merit in that the amount of blast or air flow (i.e., flow rate) can be arbitrarily set by variably designing the size or dimensions of the flow passage P in a thrust direction of the drive shaft 200.

However, the condition of generation of the vortex E becomes unstable when some load is applied to a forward end (i.e., upstream side) or a rear end (i.e., downstream side) of the impeller 100 in practical use, thus making the blast or air-blowing function thereof unstabilized. As a result, the blower can only accommodate at most about 5 mmAq (50 Pa) as its tolerance to load.

In addition, noise generated by the vanes 101 would become violent under the influence of a negative pressure generated by the vanes 101 passing by the neighborhood of the vortex E.

With the known once-through blower (once-through pump) as described above, the tongue portion 2 is provided on the inner wall of the flow passage P at a location at which the impeller 100 is mounted so as to form the cutoff structure of the bent or curved configuration inside the flow passage P, so that a swirl or vortex E is thereby generated in the impeller 100, thus accelerating the fluid F in the flow passage P. As a consequence, there arise the following problems: the acceleration performance of the blower is unstable and the acceleration efficiency thereof is low; it is easy to generate noise; and it is impossible to generate a sufficient amount of blast or air flow within a limited design space.

SUMMARY OF THE INVENTION

The present invention is intended to obviate the various problems as referred to above, and has for its object to provide a once-through pump which is improved in its pumping efficiency, thereby making it possible to reduce noise and achieve a sufficient amount of pumping fluid or flow rate even within a limited space as designed.

Bearing the above object in mind, according to a first aspect of the present invention, there is provided a once-th rough pump for accelerating fluid in a flow passage while passing the fluid through the flow passage, the pump comprising: a cylindrical impeller rotatably supported in the flow passage; a plurality of vanes provided on the outer periphery of the impeller; a drive shaft for driving the impeller to rotate; wherein the impeller has a substantially D-shaped cross sectional configuration with a suction side, at which the fluid is sucked into the impeller, being formed into a straight portion, and each of the vanes has a positive vane angle with respect to a fluid advancing direction in the straight portion. With the above construction, a once-through pump can be obtained which is able to improve the air-blowing efficiency, reduce operation noise, and achieve a sufficient amount of blast or flow rate even within a limited design space.

In a preferred form of the first aspect of the present invention, the impeller comprises: a curvable wheel portion positioned at a side end face of an outer periphery of the impeller; and straight portion forming means for forming the straight portion in a part of the wheel portion; wherein the straight portion forming means comprises a guide plate member of a substantially D-shaped configuration disposed inside the wheel portion; and the wheel portion comprises a chain member which is slidable along an outer periphery of the guide plate member, the wheel portion being driven to rotate by means of a drive shaft which is in engagement with the chain member. With the above construction, a once-through pump can be obtained which is able to easily implement the impeller of the D-shaped configuration, reduce operation noise, and achieve a sufficient amount of blast or flow rate even within a limited design space.

According to a second aspect of the present invention, there is provided a once-through pump for accelerating fluid in a fluid passage, the pump comprising: an impeller provided in the flow passage and having an axis of rotation arranged in a diametrical direction of the flow passage; a vane array including a plurality of vanes provided on an outer periphery of the impeller; and a drive shaft for driving the impeller to rotate; wherein the impeller comprises: a belt-like connecting portion for connecting and arranging the respective vanes of the vane array with one another at substantially equal intervals; a single large wheel for supporting the belt-like connecting portion from its inside; and at least one small wheel disposed at a location in opposition to and apart from the large wheel for supporting the belt-like connecting portion from its inside; wherein the vane array arranged integrally with the belt-like connecting portion includes an arc-shaped centrifugal vane array and a linear vane array compulsorily formed by the large wheel and the at least one small wheel, and the small wheel forms the linear vane array at a suction side of the fluid with respect to the impeller, and the large wheel forms the centrifugal vane array at a discharge side of the fluid with respect to the impeller. With the above construction, a once-through pump can be obtained which is able to improve the pumping efficiency, reduce operation noise, and achieve a sufficient amount of pumping flow or flow rate even within a limited design space.

According to a preferred form of the second aspect of the present invention, the drive shaft together with the at least one small wheel forms the linear vane array, and the impeller has a substantially D-shaped cross sectional configuration. Thus, a once-through pump can be obtained which is able to reduce operation noise, and achieve a sufficient amount of pumping flow or flow rate even within a limited design space.

According to another preferred form of the second aspect of the present invention, the small wheel is formed integrally with the drive shaft to provide a pair of linear vane arrays with the small wheel arranged at their center, and the impeller has a cross sectional shape formed into a substantially spindle-shaped configuration. Thus, a once-through pump can be obtained which is able to simplify the pump construction, and achieve a sufficient amount of pumping flow or flow rate even within a limited design space.

According to a further preferred form of the second aspect of the present invention, the belt-like connecting portion has a plurality of outer periphery support sections arranged at equal intervals along a rotational direction of the impeller, and the respective vanes of the vane array are fixedly secured to the outer periphery support sections, and each arranged so as to maintain a constant vane angle. Thus, a once-through pump can be obtained which is able to provide stable pumping performance, and achieve a sufficient amount of pumping flow or flow rate even within a limited design space.

According to a still further preferred form of the second aspect of the present invention, the large wheel has a plurality of outer peripheral teeth arranged at equal intervals along a rotational direction of the large wheel, and the belt-like connecting portion has a plurality of inner peripheral teeth arranged at equal intervals in a rotational direction of the impeller so as to engage the outer peripheral teeth of the large wheel, and the outer peripheral teeth and the inner peripheral teeth are tuned to support dimensions of the cross sectional shape of the impeller at a plurality of locations including opposite axial ends of the impeller for preventing occurrence of distortion of the vanes at the opposite axial ends of the impeller. Thus, a once-through pump can be obtained which is able to avoid the generation of vibration, and achieve a sufficient amount of pumping flow or flow rate even within a limited design space.

According to a yet further preferred form of the second aspect of the present invention, the inner peripheral teeth of the belt-like connecting portion are formed integrally with the outer periphery support sections at a same pitch at which the outer periphery support sections are arranged. Thus, a once-through pump can be obtained which is able to improve precision in manufacturing the belt-like connecting portion, and achieve a sufficient amount of pumping flow or flow rate even within a limited design space.

According to a further preferred form of the second aspect of the present invention, each of the inner peripheral teeth of the belt-like connecting portion and the outer periphery support sections has a deformable quadrilateral cross sectional shape, and the outer peripheral teeth of the large wheel are formed into slant embossed shapes with respect to a rotational direction of the impeller and the large wheel, so that the quadrilateral cross sectional shape can be deformed in a direction to increase the vane angle of each of the vanes. Thus, a once-through pump can be obtained which is able to arbitrarily change the vane angle and improve the pumping performance.

According to a further preferred form of the second aspect of the present invention, the large wheel is formed integrally with the drive shaft. Thus, a once-through pump can be obtained which is able to change the vane angle in a centrifugal vane array in a reliable manner.

The above and other objects, features and advantages of the present invention will become more readily apparent to those skilled in the art from the following detailed description of preferred embodiments of the present invention taken in conjunction with the accompanying drawings.

BRIEF DESCRIPTION OF THE DRAWINGS

FIG. 6 is a side elevation illustrating a curved portion between a straight portion and an arc portion according to a second embodiment of the present invention.

FIGS. 7A and 7B are perspective views illustrating a connecting portion formed into a plate-shaped configuration according to a third embodiment of the present invention.

DESCRIPTION OF THE PREFERRED EMBODIMENTS

Now, preferred embodiments of the present invention will be described in detail with reference to the accompanying drawings while taking an example of a once-through blower as in the above-mentioned known one.

Embodiment 1

Figure 1:
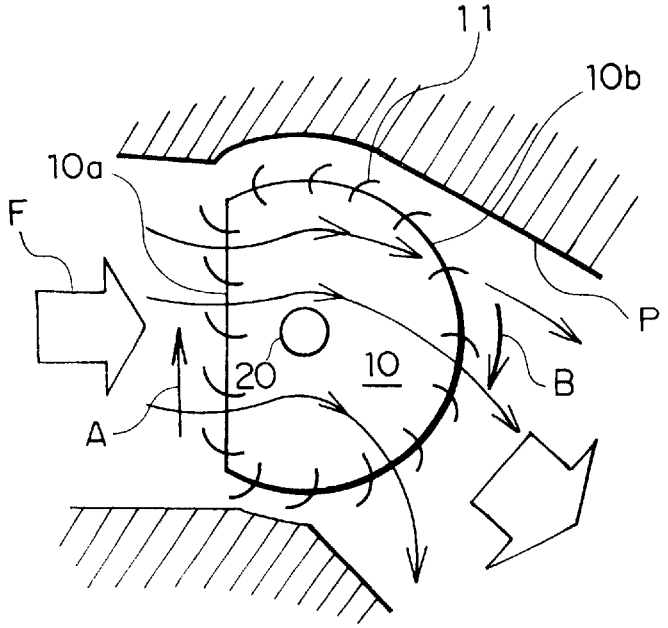
FIG. 1 is a cross sectional side view schematically illustrating an impeller according to a first embodiment of the present invention.
Figure 25:
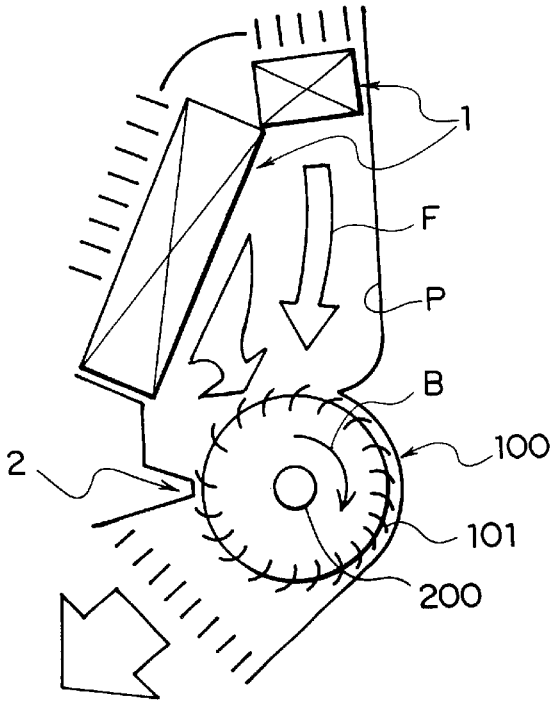
FIG. 25 is a cross sectional side view illustrating a known once-through pump (once-through blower).
Figure 26:
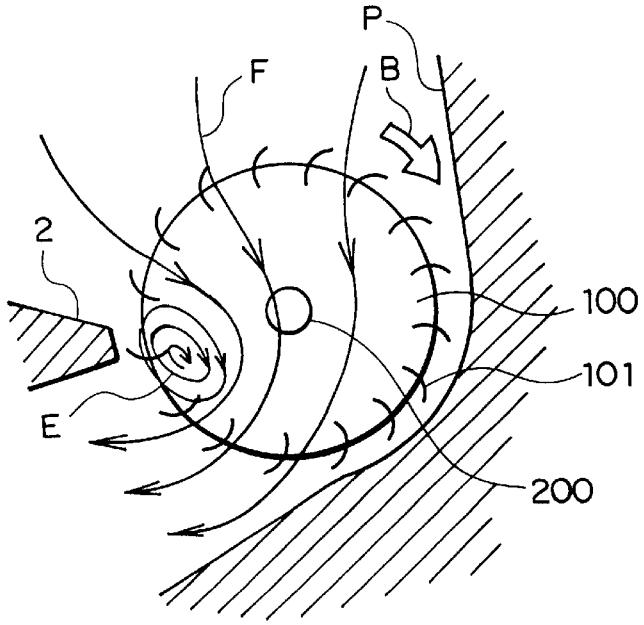
FIG. 26 is an enlarged cross sectional view illustrating the operation of fluid F in the vicinity of an impeller in FIG. 25.

FIG. 1 is a cross sectional side view illustrating a first embodiment of the present invention. In this figure, the same or corresponding parts or elements as those in the aforementioned known example described with reference to FIG. 25 and FIG. 26 are identified by the same symbols while omitting a detailed description thereof.

In FIG. 1, an impeller, generally designated at 10, is provided on the outer periphery thereof with a plurality of vanes 11, and it is disposed in and rotatably supported through a rotation shaft 20 in a flow passage P such as a channel, duct or the like so that it is driven to rotate in a direction of arrow B around the rotation shaft 20.

The impeller 10 has a substantially D-shaped cross section including a straight portion 10*a* formed on its suction or inlet side for fluid F, and an arc portion 10*b* formed on its discharge or outlet side for fluid F.

Also, the impeller 10 is formed on its outer periphery with a plurality of vanes 11, each of which has a positive vane angle with respect to the advancing direction (see arrow A) in the straight portion 10*a*.

Figure 2:
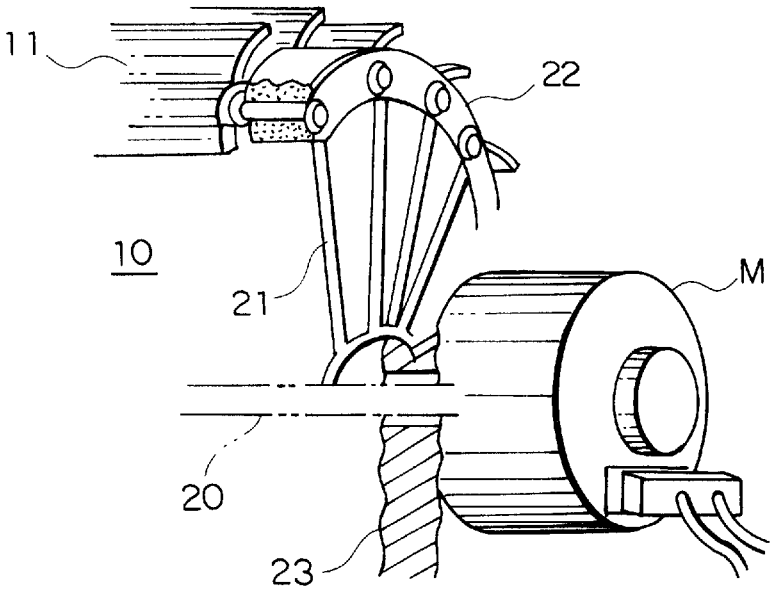
FIG. 2 is an perspective view illustrating, on an enlarged scale, essential portions of a once-through pump according to the first embodiment of the present invention.

FIG. 2 is a perspective view illustrating, on an enlarged scale, essential portions of a once-through blower according to the first embodiment of the present invention.

In FIG. 2, the impeller 10 has a plurality of connecting portions 21 connected at their one ends with the rotation shaft 20, a wheel portion 22 connected with the other ends of the connecting portions 21, and an unillustrated straight portion forming means to be described later.

The rotation shaft 20 of the impeller 10 has its one end extending through a side plate 23 so as to project outside, so that the output shaft of a motor M is coupled with the outwardly projected end of the rotation shaft 20 for driving the impeller 10 to rotate.

The side plate 23 is arranged to cover an entire side portion of the blower, thereby preventing backflow of the fluid F from the blower side portion.

The connecting portions 21 are each made of a flexible member such as, for example, a wire-like member, and serve to connect the wheel portion 22 with the rotation shaft 20 of the impeller 10.

The wheel portion 22 is made of an elastic material such as silicon rubber and it is arranged in a curvable or flexible manner on the outer peripheral portion of the impeller 22 at each of the sides thereof.

The straight portion forming means forms the straight portion 10*a* in a part of the wheel portion 22.

Figure 3:
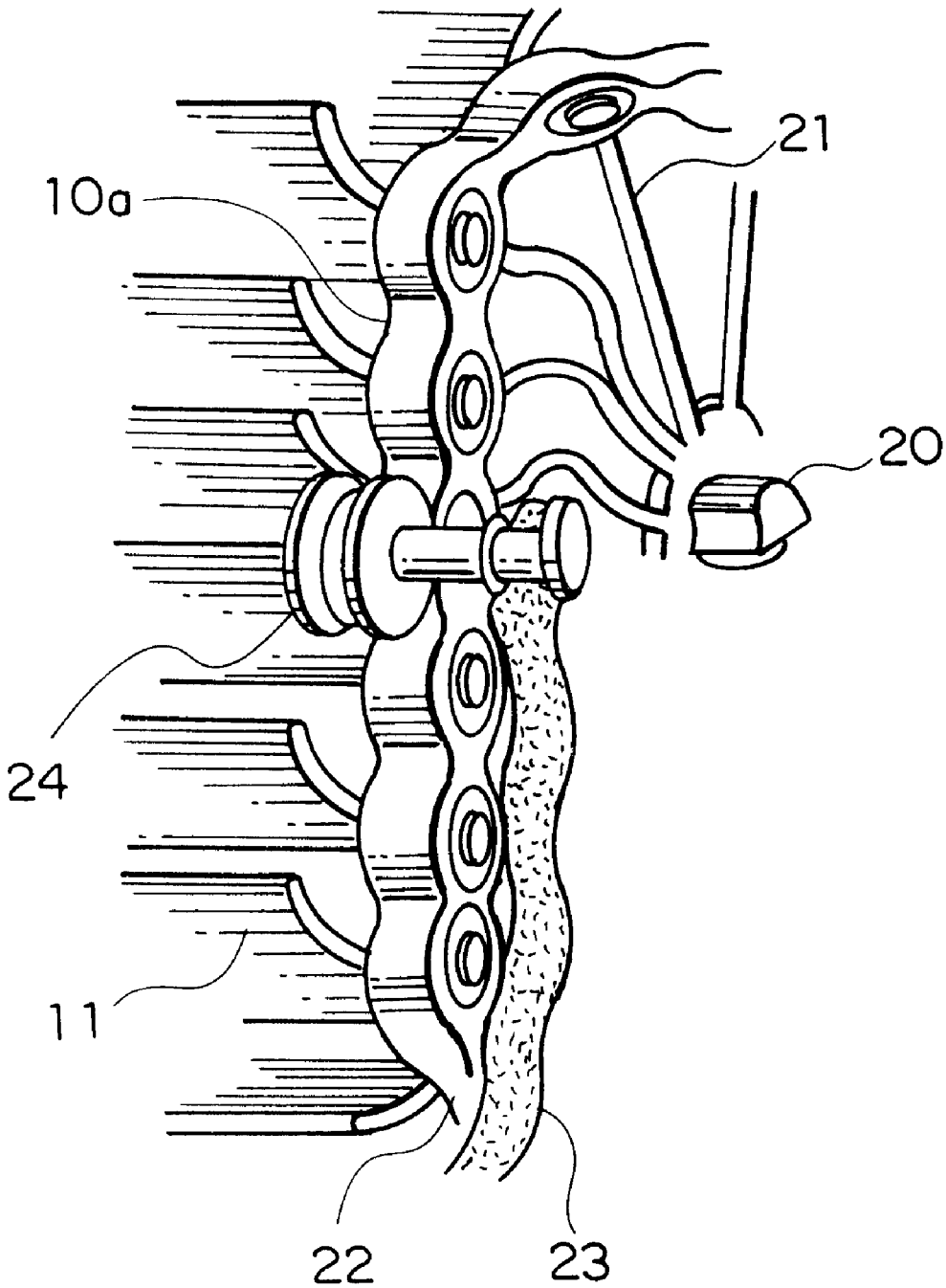
FIG. 3 is a perspective view illustrating a concrete example of a straight portion forming means according to the first embodiment of the present invention.

FIG. 3 is a perspective view illustrating a concrete example of the straight portion forming means according to the first embodiment of the present invention.

In FIG. 3, a pulley-shaped guide roller 24 is fixedly secured to the side plate 23 thereby to constitute the straight portion forming means for providing the straight portion 10*a* to the wheel portion 22.

The guide roller 24 serves to guide a part of the wheel portion 22 from the outside thereof to forcedly position it in place, thus forming the straight portion 10*a*.

Figure 4A:
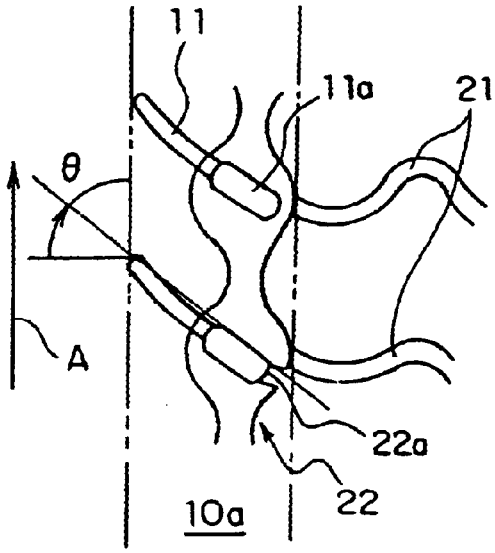
FIG. 4A and FIG. 4B are side views illustrating a straight portion and an arc portion, respectively, according to the first embodiment of the present invention.
Figure 4B:
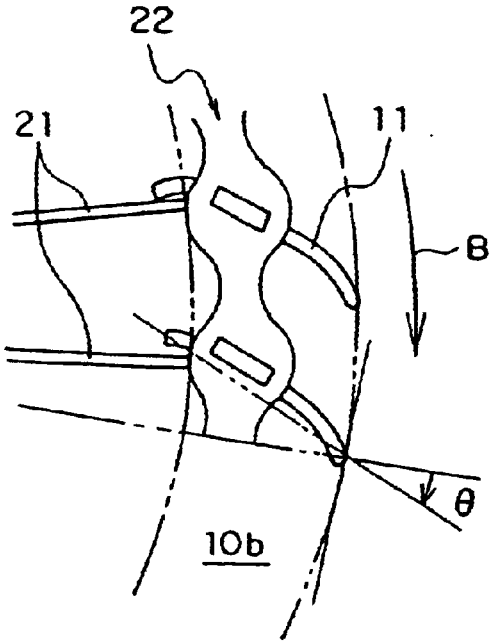

FIG. 4A and FIG. 4B are side views illustrating the straight portion 10*a* and the arc portion 10*b*, respectively, according to the first embodiment of the present invention.

In FIG. 4A and FIG. 4B, each of the vanes 11 is formed at its radially outer end with a support shaft 11*a*, so that it is inserted into and fixedly secured to the wheel portion 22 through the support shaft 11*a*.

In addition, each of the vanes 11 has a positive vane angle θ with respect to an advancing direction A at the arc portion 10*b*, and to a rotational direction B at the straight portion 10*a*.

Here, note that each pair of support shafts 11*a* are made of resin and integrally formed with and molded to the opposite sides of a corresponding vane 11.

Moreover, the wheel portion 22 is provided with a plurality of openings 22*a* at locations corresponding to the support shafts 11*a*.

The respective vanes 11 are fixed to the wheel portion 22 by inserting and fixing the support shafts 11*a* into and to the corresponding openings 22*a* in the wheel portion 22.

Figure 5A:
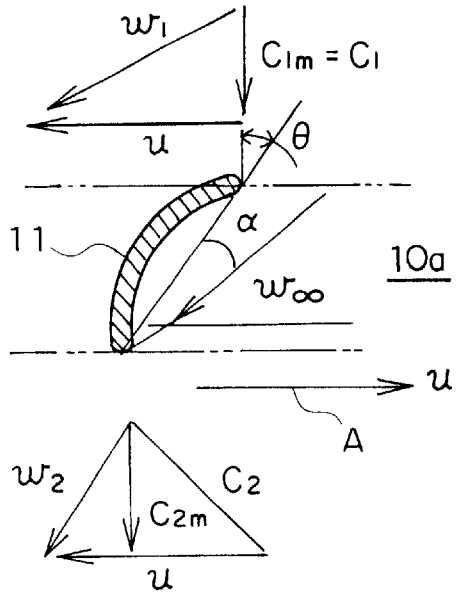
FIG. 5A and FIG. 5B are explanatory views illustrating velocity triangles at the straight portion and at the arc portion, respectively, according to the vane angles of vanes according to the first embodiment of the present invention.
Figure 5B:
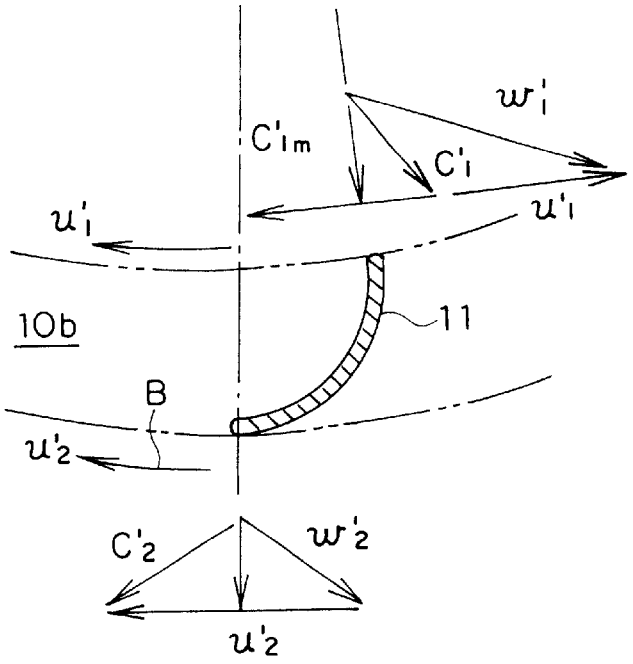

FIG. 5A and FIG. 5B are explanatory views illustrating velocity triangles (i.e., vector diagrams) in the straight portion 10*a* and in the arc portion 10*b*, respectively, according to the vane angle θ of each vane 11.

In FIG. 5A, an average relative speed $w\infty$ is an average value of a relative speed w1 at the suction or inlet side of the impeller 10 and an average relative speed w2 at the discharge or outlet side thereof. Additionally, an angle $\alpha$ is an actual angle of attack with respect to the fluid F.

Hereinafter, reference will be made to a concrete air-blowing operation according to the first embodiment of the present invention while referring to FIG. 1 through FIG. 4 and FIG. 5A and FIG. 5B.

In the once-through blower according to the first embodiment of the present invention, basically, rotational centrosymmetry of the impeller 10 is partially broken to provide a D-shaped cross sectional configuration, as shown in FIG. 1.

With such a configuration, in the straight portion 10*a*, a force is applied to the fluid F in a direction from the right to the left in FIG. 1 by means of a straight or linear array of vanes, and in the arc portion 10*b*, a centrifugal force is further applied to the fluid F, thereby ensuring that the fluid F can be caused to flow from the left to the right.

At this time, in the straight portion 10*a*, it is possible to raise the pressure of the fluid F by about 9 mmAq (90 Pa), though somewhat varied depending on the conditions given.

In addition, in the arc portion 10*b*, it is possible to obtain a pressure increase of about 18 mmAq (180 Pa) in cases where the diameter of the arc portion 10*b* is particularly large so as to generate a large centrifugal force.

Accordingly, by using the D-shaped configuration as depicted in FIG. 1, it is possible to obtain a pressure rise of the fluid F of about 27 mmAq (270 Pa) in total.

Besides, the structure in the axial direction of the impeller 10 can arbitrarily be extended so as to adapt the blower to an optional amount of blast or flow rate as required.

Thus, a sufficient amount of blast or flow rate as required can be provided even in case of a bad condition (e.g., in a limited space available for installation with a high flow resistance of the flow passage P).

Concretely, the wheel portion 22 made of silicon rubber (see FIG. 2 through FIG. 4) is connected with the rotation shaft 20 through the flexible connecting portions 21, and the guide roller 24 (see FIG. 3) is pressed against a part of the wheel portion 22 so as to achieve a D-shaped cross sectional configuration.

Therefore, a part of the impeller 10 is compulsorily crushed by the guide roller 24 to form the straight portion 10*a*, whereby the vanes 11 carry out linear motion.

Z(=from 20 to 60) pieces of vanes 11 each have a vane angle $\theta$ (=form 10° to 45°) for instance in a forward direction with respect to the advancing direction A and the rotational direction B, and are arranged at equal or unequal intervals.

Moreover, the vanes 11 support about the half of vane camber (or an inner side portion from the half) to the support shafts 11*a*, as illustrated in FIG. 4, and they are normally fixed to the wheel portion 22 against rotation relative thereto.

As a result, the vanes 11 advance while holding the vane angle $\theta$ in the advancing direction, so they are subjected to an application force without any centrifugal force.

At this time, the amount of pressure rise $\Delta Pt$ of the fluid F due to passage thereof through the impeller 10 is expressed by the following equation (1) based on Bernoulli's theorem (Bernoulli law).

$$\Delta Pt=(1/2)\rho(w_1^2-w_2^2)+(1/2)\rho(c_2^2-c_1^2) \quad (1)$$

where $\rho$ represent the density of the fluid F; w represents the speed of the fluid F relative to the vanes 11; c represents the absolute velocity of the fluid F; $w_1$ represents the initial speed of the fluid F relative to the vanes 11; $c_1$ represents the absolute initial velocity of the fluid F; $w_2$ represents the speed of the fluid F relative to the vanes 11 after the fluid F has passed the vanes 11 (i.e., after the lapse of a time); $c_2$ represents the absolute velocity of the fluid F after the fluid F has passed the vanes 11 (i.e., after the lapse of a time) (see the velocity triangles in FIG. 5A and FIG. 5B).

In equation (1) above, the first term on the right side of the equal sign represents the amount of static pressure rise due to a decrease in the speed w of the fluid F relative to the impeller 10, and the second term on the same side represents the amount of dynamic pressure rise due to an increase in the absolute velocity c of the fluid F according to the rotational force of the impeller 10.

Here, a part of dynamic pressure is converted into a static pressure in the space inside the impeller 10, the most part of which achieves a static pressure rise enough to increase the pressure by about 9 mmAq to the right-hand side in the straight portion 10*a*.

In addition, the impeller 10, which rotates together with the rotation shaft 20 through the connecting portions 21, functions substantially as a centrifugal blower to raise the pressure of the fluid F in the blowing direction while applying a forward force to the fluid F.

At this time, the impeller 10 functions as a booster, and the amount of pressure $\Delta Pt'$ of the fluid F is expressed by the following equation (2).

$$\Delta Pt'=(1/2)\rho(u_2'^2-u_1'^2)+(1/2)\rho(w_1'^2-w_2'^2)+(1/2)\rho(c_2'^2-c_1'^2) \quad (2)$$

where u represent the rotational speed of the impeller 10; $u_1'$ represents the initial rotating speed of the impeller 10; and $u_2'$ represents the rotating speed of the impeller 10 after passage of the fluid (after the lapse of a time).

Moreover, in equation (2) above, the third term on the right side of the equal sign is the part of a dynamic pressure rise, and occupies more than one-half of the force applied by the rotation shaft 20 in cases where the vanes 11 comprise forwardly directed vanes of a short cord length.

Thus, it is possible to realize a static pressure rise of about 18 mmAq by recovering the rise of the dynamic pressure in the third term into a static pressure in an expanding or divergent duct portion which expands or diverges gradually while turning at the downstream side of the blower.

As a result, owing to the pressure rise in equation (2) above in combination with the pressure rise in equation (1) above, the total pressure of the fluid F can be raised by 27 mmAq or so.

In this manner, since the fluid F (air stream) can be pressurized twice by means of the array of vanes 11 arranged in the generally D-shaped configuration, the final pressure rise becomes greater in this embodiment than in the case of axial-flow blowers or the aforementioned known once-through blower (see FIG. 25 and FIG. 26) with a flow passage of the same diameter.

In addition, in the case of the once-through blower in which an arbitrary depth space can be set in the axial direction as previously described, there is no limitation on the amount of blast or flow rate.

Moreover, the fluid F is curved or bent in its flowing or advancing direction in the straight portion 10*a* of the impeller 10, but after having passed the straight portion 10*a*, it is dispersed in the following portion of the impeller 10 to reduce its absolute velocities $c_2m$, $C_2$ so that it enters the arc portion 10*b* at the absolute velocities of $c_1m'$ and $c_1'$ (see FIG. 5A and FIG. 5B).

This means that in case of the once-through blower, the fluid F flows into the arc portion 10*b* while having a turning component in advance, and hence this is a somewhat severe inflow state for the vanes 11.

However, like the velocity triangle illustrated in FIG. 5A and FIG. 5B, the fluid F in the arc portion 10*b* is pressurized in a downward direction in these figures so that the blower acts as a contrarotating blower to recover the bending speed, thus achieving high efficiency.

It is more effective if provision is made for stationary vanes (not shown) between the straight portion 10*a* and the arc portion 10*b* for recovering an advancing direction component (pre-turning component to the later-stage arc portion 10*b*) of the fluid F which exits from the straight portion 10*a*.

On the other hand, when considering the sound generated during rotation of the impeller 10, it is not necessary for the once-through blower according to the first embodiment of the present invention (FIG. 1 through FIG. 5) to adopt the flow channel or duct structure of the aforementioned known once-through blower (see FIG. 25 and FIG. 26)(i.e., the markedly asymmetric bent or turned configuration provided by the tongue portion 2), and hence the bending or turning angle of the flow passage or duct in this embodiment can be made much more gradual than in the known case, thus making it possible to reduce resultant noise to a considerable extent.

Particularly, in the case of the once-through blower according to the first embodiment of the present invention, the fluid F applied by the turning force forms a large swirl or vortex localized near the rotation shaft 20, which, however, is generated at a location away from the vane array unlike the swirl or vortex E generated in the aforementioned known once-through blower (see FIG. 26), so interference sounds of the fluid F with the vane arrays can be reduced to a substantial extent, thereby suppressing resultant noise in an effective manner.

Moreover, the connection between the wire-like connecting portions 21 and the rotation shaft (drive shaft) 20 is effected, for instance, by fixing the connecting portions 21 to a drive shaft disk (not shown) of the rotation shaft 20.

At this time, the connection point between the connecting portions 21 and the rotation shaft 20 may be constructed to allow relative rotation with respect to each other, thereby making it possible to prevent deformation stress from being concentrated on the drive end of the rotation shaft 20.

Embodiment 2

In the above-mentioned first embodiment, the support shafts 11*a* integrally formed with the vanes 11 are used in the fixing structure for fixing the vanes 11 to the impeller 22, but they may be constituted by vanes 11 and support rods 12 which are formed separately from each other, made of different materials (for example, the vanes 11 are made of a resin and the support rods are made of a metal) and then assembled together into an integral unit.

FIG. 6 is a side elevation illustrating a curved portion between the straight portion 10*a* and the arc portion 10*b* according to a second embodiment of the present invention.

In FIG. 6, the structure in a circumferential direction of the wheel portion 22 is formed into a uniform belt-shaped configuration so as to enclose openings 22*a* (see FIG. 7) corresponding to the support rods 12, but it is formed with notches 22*b* which serve to facilitate the deformation thereof into the straight portion 10*a* and the arc portion 10*b*, and the intervals between the support portions of the respective vanes 11 are set to be as narrow as possible.

The circumferential portion of the wheel portion 22 may have an increased thickness for the purpose of preventing swing or oscillating motions, as in the aforementioned first embodiment.

The vanes 11 thus fixed to the wheel portion 22 are caused to rotate by means of the rotating force of the rotation shaft 20 through the connecting portions 21, as illustrated in FIG. 6.

At this time, the connecting portions 21, being of the wire-like configuration and having a limited amount of expansion, limits the movement of the wheel portion 22 in a radial direction thereof in the arc portion 10*b* as in the above-mentioned first embodiment, whereas they are easily deformable in a compressive direction, thereby permitting free compressive deformation of the wheel portion 22 in the straight portion 10*a*.

In addition, the wire-like connecting portions 21 may be made of an elastic material.

Embodiment 3

Although in the above-mentioned first and second embodiments, the connecting portions 21 are formed into the wire-like configuration, they may be formed into a plate-like configuration.

FIG. 7A and FIG. 7B are perspective views illustrating the connecting portions 21 constructed in a plate-like configuration according to a third embodiment of the present invention, wherein FIG. 7*a* shows the case in which notches 21*b* are formed on a curved surface, and FIG. 7*b* shows the case in which a continuous bracelet structure is provided on a curved surface.

In FIG. 7*a*, the tip end of each support rod 12 is inserted into and fixedly attached to a corresponding opening 22*a* in the wheel portion 22.

For instance, the tip end of each support rod 12 is engaged with the corresponding opening 22*a* in the wheel portion 22 against rotation relative thereto.

Also, each support rod 12 is formed at its tip with a notch, bent portion or the like as necessary so as to prevent any displacement thereof relative to the wheel portion 22. In addition, the tip end of each support rod 12 is melted in and sealed with the corresponding opening 22*a* so that it is securely fixed to the wheel portion 22.

Moreover, the wheel portion 22 is required to have a thickness more than a certain level or value in order to prevent oscillations in a thrust direction and hold an arc-shaped configuration in the circumferential direction, so the axial thickness of the wheel portion 22 is properly set according to the modulus of elasticity of a material (e.g., silicon rubber, etc.) used, the diameter of the wheel portion 22 and so on.

Providing an arbitrary number of notches 21*b* at a location between the opposite ends of each connecting portion 21, as depicted in FIG. 7A, serves to permit the connecting portions 21 to be deformed in an arbitrary direction such as, for example, in a radially inner direction, in an advancing direction, etc.

The notches 21*b* can be formed on at least one of the outer peripheral side and the inner peripheral side of the curved surfaces of the connecting portions 21.

Moreover, in FIG. 7A, the connecting portions 21 have the openings 21*a* corresponding to the openings 22*a* in the wheel portion 22, respectively, and are fixed to the wheel portion 22 through the support rods 12.

Similarly, in FIG. 7B, the connecting portions 21, being of the bracelet structure, can be deflected or curved in an arbitrary direction.

Further, in FIG. 7B, each connecting portion 21 has an engagement rod 21*c* corresponding to another opening 22*c* in the wheel portion 22, so that it is fixed to the wheel portion 22 by being inserted into the corresponding opening 22*c*.

In addition, in FIG. 7A and FIG. 7B, the connecting portions 21 may be constituted by resin plates.

Since the connecting portions 21 each formed into the plate-like configuration as shown in FIG. 7A and FIG. 7B have a sufficient thickness in the thrust direction, thrust oscillations of the wheel portion 22 can be made to a minimum.

Moreover, providing one or more notches 21*b*, as shown in FIG. 7A, serves to facilitate the compressive deformation in the rotational direction of the connecting portions 21.

That is, the connecting portions 21 can be compressively deformed easily in one (forward or rearward) direction under the action of the notches 21*b*.

Therefore, it is possible to avoid mutual interference between the connecting portions 21.

Embodiment 4

Although in the above-mentioned third embodiment, the plate-like connecting portions 21 are constructed such that they can be deflected or curved in the rotational direction thereof, they may instead be constructed so as to be deflected or curved in the direction of thrust.

Figure 8:
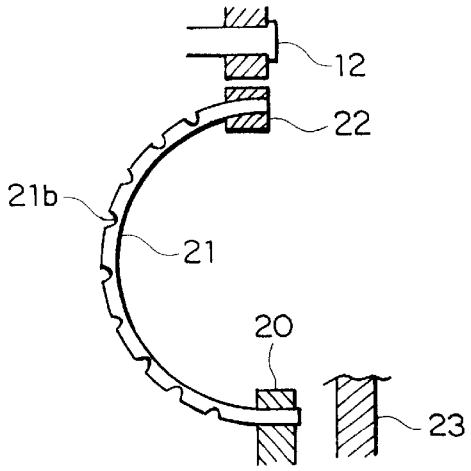
FIG. 8 is a cross sectional view illustrating a connecting portion according to a fourth embodiment of the present invention.

FIG. 8 is a cross sectional view illustrating connecting portions 21, which can be deflected or curved in the thrust direction, according to a fourth embodiment of the present invention.

In FIG. 8, the direction in which the connecting portions 21 are deformed to curve is set to be in the radially inward direction of the side plates 23, so there will be no interference of the connecting portions 21 with the side plates 23.

Moreover, the direction in which the connecting portions 21 are deformed to curve or bend can be arbitrarily set depending on an angle formed by the notches 21*b*, so that the connecting portions 21 can be curved or bent substantially perpendicularly toward the inside of the impeller 10.

Concretely, the curving or bending direction of the connecting portions 21 is set inwardly of the once-through blower in relation to the arrangement of the side plates 23 of the once-through blower.

According to the construction of FIG. 8, mutual interference between the connecting portions 21 can surely be avoided.

Moreover, in the arrangement of FIG. 8, similar to the aforementioned embodiments, the connections between the connecting portions 21 and the rotation shaft 20 can be made by fixing the connecting portions 21 to an unillustrated drive shaft disk of the rotation shaft 20. Thus, the connection point between the connecting portions 21 and the rotation shaft 20 may be constructed to allow relative rotation with respect to each other, thereby making it possible to suppress concentration of deformation stress on the drive end of the rotation shaft 20.

Embodiment 5

Although in the above-mentioned first and second embodiments, the wire-like connecting portions 21 are each fixed to the rotation shaft 20 and the wheel portion 22, respectively, at one point for each of them, such connections may be made in an X-shaped or crossed fashion at a plurality of points for each connection.

Figure 9:
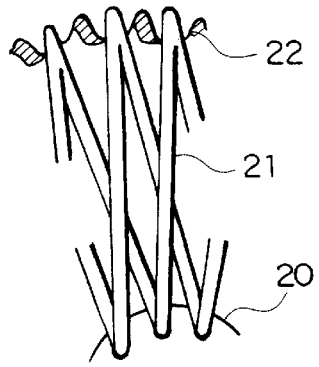
FIG. 9 is a side elevation illustrating a connecting portion according to a fifth embodiment of the present invention.

FIG. 9 is a side elevation illustrating connecting portions 21, which are formed in an X-shaped or crossed fashion, according to a fifth embodiment of the present invention.

In FIG. 9, each of the wire-like connecting portions 21 has a three-point connection structure including one connection point with respect to the wheel portion 22 and two connection points with respect to the rotation shaft 20.

The construction of FIG. 9 serves to strengthen the connection structure for connecting between the wheel portion 22 and the rotation shaft 20 through the connecting portions 21, so that high transmission efficiency for the rotational force and minimization of fluctuations in rotation of the once-through blower can be achieved at the same time.

Embodiment 6

Figure 10:
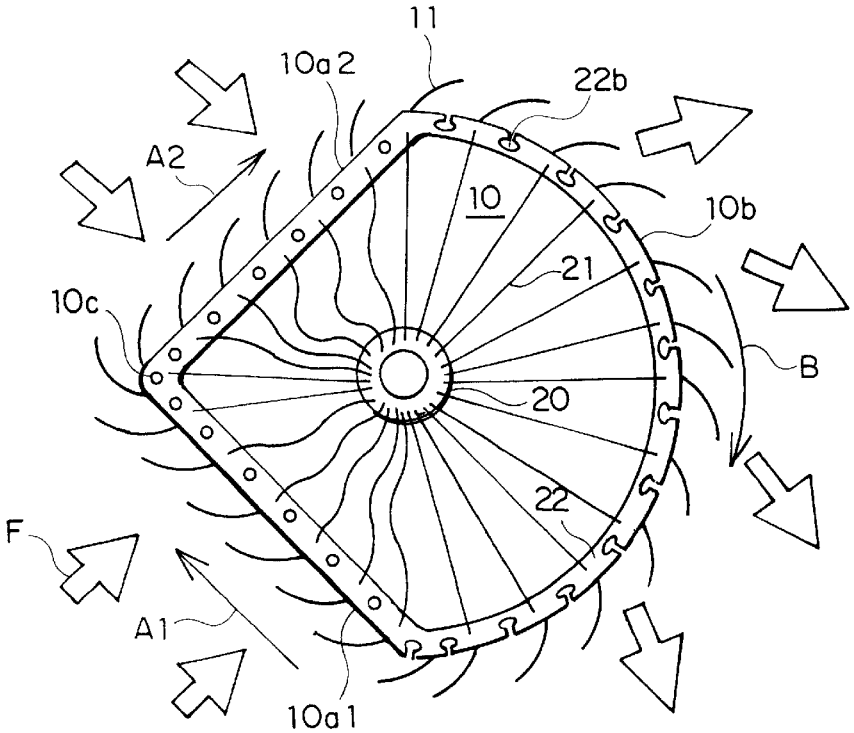
FIG. 10 is a side elevation illustrating an impeller according to a sixth embodiment of the present invention.

Although in the above-mentioned first embodiment, the wheel portion 22 is formed into the completely D-shaped configuration, it may be formed on the straight portion with an outwardly projected bend portion, as shown in FIG. 10.

FIG. 10 is a side elevation illustrating an impeller 10 with a bend portion 10*c* formed in its straight portion according to a sixth embodiment of the present invention.

In FIG. 10, the wheel portion 22 has the bend portion 10*c* in the straight portion, which includes two straight sections 10*a*1 and 10*a*2.

The wheel portion 22 is basically formed into a generally D-shaped configuration as described above, but in cases where the area in the straight portion is far less than that in the arc portion 10*b*, the bend portion 10*c* is provided to the straight portion, as shown in FIG. 10.

With this provision, there is formed a curved or bent configuration enclosed by the two straight sections 10*a*1 and 10*a*2, so that a sufficient area can be ensured in the straight portion, thus permitting an enough amount of fluid F to be thereby drawn.

Embodiment 7

Figure 11:
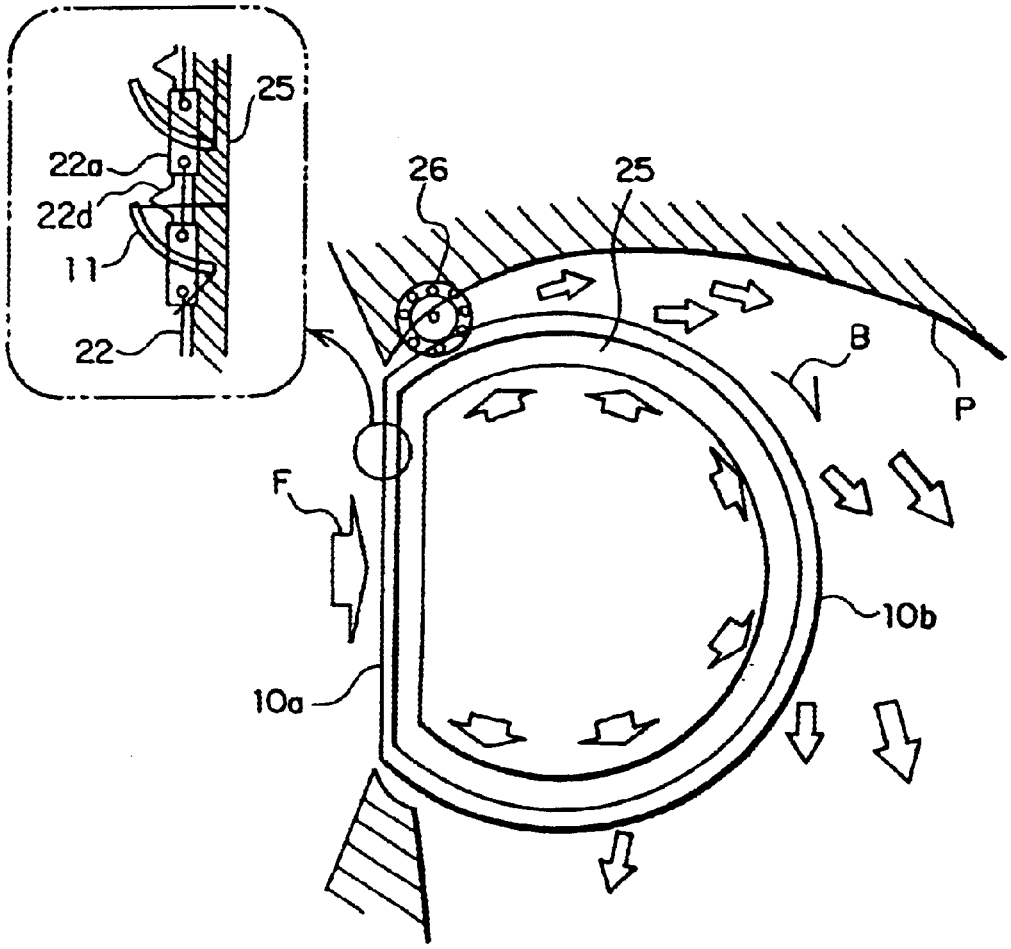
FIG. 11 is a side elevation illustrating the neighborhood of a wheel portion according to a seventh embodiment of the present invention.

Although in the above-mentioned first embodiment, the guide roller 24 is used as a straight portion forming means for forming the wheel portion 22 into a D-shaped configuration, a D-shaped guide plate member 25 may be used for the same purpose, as shown in FIG. 11.

FIG. 11 is a side elevation illustrating the surroundings of a wheel portion 22 using the guide plate member 25 as the straight portion forming means according to a seventh embodiment of the present invention, in which an impeller 10 is partially illustrated on an enlarged scale so as to avoid complexity.

In FIG. 11, the guide plate member 25 formed of an iron plate for instance is arranged inside the wheel portion 22, and it is formed into a D-shaped configuration having a straight portion 10*a* and an arc portion 10*b*.

The straight portion 10*a* of the guide plate member 25 may be provided with the above-mentioned bend portion 10*c* (see FIG. 10).

The wheel portion 22 is constituted by a chain member 22*a* which is slidable along the outer periphery of the guide plate member 25, the chain member being adapted to be driven to rotate by means of a motor (not shown) through a drive shaft 26 which is in engagement with the chain member.

The wheel 22 in the form of the chain member has teeth 22*d* to which vanes 11 and support rods are fixedly secured against rotation, so that the wheel portion 22 is caused to slide on the guide plate member 25, thereby generating a stream of air.

In this case, in order to minimize a mechanical friction loss as well as noise generated, there is interposed lubricating oil between the wheel portion 22 in the form of the chain member and the guide plate member 25 formed of an iron plate.

Moreover, the contact portions of the wheel portion 22 and the guide plate member 25 are made of combinations of materials with a limited coefficient of friction such as Teflon, so as to be smoothly slidable with respect to each other to a sufficient extent.

In addition, the output shaft of the unillustrated motor is operatively connected through the drive shaft 26 with the wheel portion 22 in the form of a gear, so that it can drive the wheel portion 22 through the drive shaft 26.

Here, note that the output shaft of the motor may be provided with receiving or engagement teeth which is directly engageable with the teeth 22*d* of the wheel portion 22, and in this case, the motor can directly drive the wheel portion 22 without using the drive shaft 26.

When the guide plate member 25 is used as shown in FIG. 11, it becomes unnecessary to employ the pressing guide roller 24 (see FIG. 3) for forming the straight portion 10*a*.

Further, the wheel portion 22 slides directly on the guide plate member 25, and hence the connecting portions 21 as described above become unnecessary, too.

Embodiment 8

Figure 12:
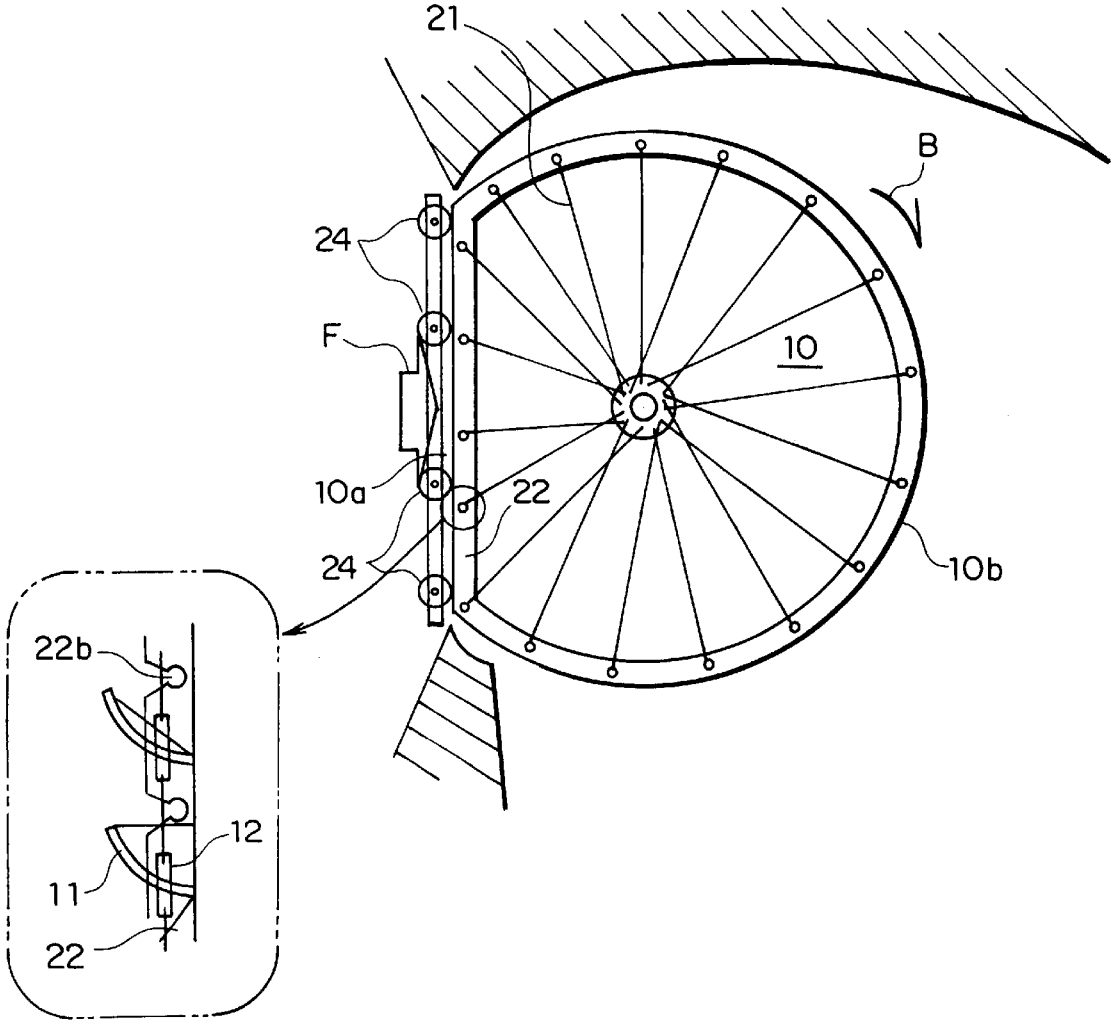
FIG. 12 is a side elevation illustrating the neighborhood of a wheel portion according to an eighth embodiment of the present invention.

Although in the above-mentioned first embodiment, the single guide roller 24 is provided as the straight portion forming means, a plurality of guide rollers 24 may be arranged in parallel with one another, as shown in FIG. 12.

FIG. 12 is a side elevation illustrating the surroundings of a wheel portion 22 using the plurality of guide rollers 24 according to an eighth embodiment of the present invention, in which an impeller 10 is partially illustrated on an enlarged scale so as to avoid complexity.

In FIG. 12, the plurality of guide rollers 24 are arranged along a straight portion 10*a* of the impeller 10.

With this arrangement, the pressing function of the guide rollers 24 can be achieved in a more reliable manner.

Here, note that if the surface of each guide roller 24 is provided with irregularities (convexes and concaves) for decreasing the area of contact thereof with the wheel portion 22 in addition to the use of the guide members with limited sliding frictions, it is possible to further improve the sliding effect.

Embodiment 9

Figure 13:
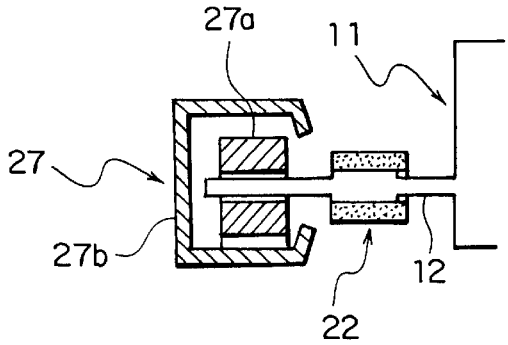
FIG. 13 is a cross sectional view illustrating the neighborhood of a pulley mechanism according to a ninth embodiment of the present invention.

Although in the above-mentioned first embodiment, the guide roller 24 is used as the straight portion forming means, a pulley mechanism 27 formed integral with a wheel portion 22 may instead be employed, as shown in FIG. 13.

FIG. 13 is a cross sectional view illustrating the surroundings of the pulley mechanism 27 according to a ninth embodiment of the present invention.

In FIG. 13, the pulley mechanism 27 is provided on one end of the wheel portion 22.

The pulley mechanism 27 comprises a roller 27*a* rotatably mounted on the wheel portion 22, and a guide rail 27*b* for guiding the roller 27*a*.

In this case, the guide rail 27*b* is formed into a D-shaped configuraion with a U-shaped cross section.

In addition, the wheel portion 22 serves to position and fix vanes 11 through support rods 12, thus holding a predetermined vane angle of the vanes 11.

Here, note that the wheel portion 22 may be driven by the above-mentioned connecting portions 21.

Thus, with the arrangement in which the comparatively small pulley mechanism (guide roller mechanism) 27 is incorporated in or provided at one end of the wheel portion 22 to permit the roller 27*a* to be rolled within the guide rail 27*b*, as shown in FIG. 13, it is possible to further reduce a driving loss of the wheel portion 22.

Moreover, by using the guide rail 27*b* of the pulley mechanism 27, the wheel portion 22 can be driven to move under the guidance of the guide rail 27*b* without the necessity of aligning the rotation shaft 20 (see FIG. 1) with the drive shaft, as in the case of using the guide plate member 25 and the chain member (see FIG. 1).

Embodiment 10

Figure 14:
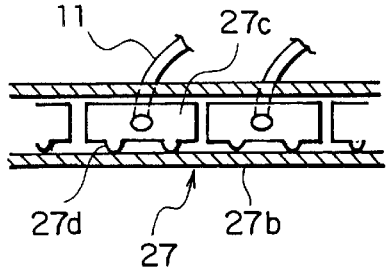
FIG. 14 is a cross sectional side view illustrating a pulley mechanism according to a tenth embodiment of the present invention.

Although in the above-mentioned ninth embodiment, the roller 27*a* is rotated within the guide rail 27*b*, the pulley mechanism 27 may have a roller portion 27*c* which is slidable within the guide rail 27*b*, as shown in FIG. 14.

FIG. 14 is a cross sectional side view illustrating a pulley mechanism 27 having the roller portion 27*c* slidable within the guide rail 27*b* according to a tenth embodiment of the present invention.

In FIG. 14, the roller portion 27*c* is arranged to slide within the guide rail 27*b* of the pulley mechanism 27.

The roller portion 27*c* has protrusions 27*d* for reducing the contact area thereof with the guide rail 27*b*.

In this case, the wheel portion 22 can be driven to move by the above-mentioned connecting portions 21.

In FIG. 14, the wheel portion 22 has limited elasticity and merely functions as a spacer for holding appropriate intervals between the adjacent ones of the vanes 11. The wheel portion 22 is slidable within the D-shaped guide rail 27*b* through the roller portion 27*c* in the form of rod-like protrusions provided at one end of the wheel portion 22.

In this case, too, as previously stated, it is possible to reduce a slipping loss by providing irregularities (e.g., convexes and concaves) on the contact surfaces of the guide rail 27*b* and the roller portion 27*c*.

Here, note that the roller portion 27*c* need not be provided on the wheel portion 22 but may instead be installed on the wire-like or plate-like connecting portions 21.

According to the pulley mechanism 27 shown in FIG. 14, it is possible to construct the guide rail 27*b* in a small size to thereby make the impeller 10 compact and small-sized as a whole, though driving resistance becomes larger to a slight extent.

Embodiment 11

Figure 15:
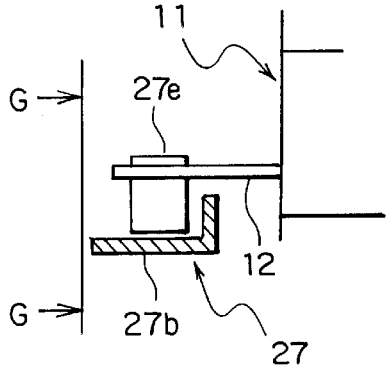
FIG. 15 is a cross sectional side view illustrating a pulley mechanism according to an eleventh embodiment of the present invention.
Figure 16:
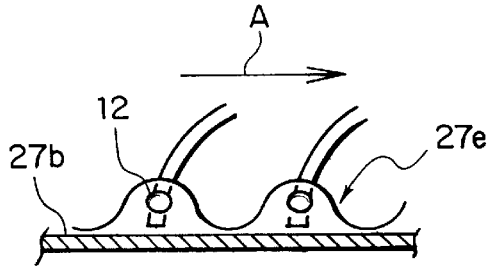
FIG. 16 is a cross sectional view taken along line G—G in FIG. 15.

Although in the above-mentioned tenth embodiment, the roller portion 27*c* is slidable within the guide rail 27*b*, there may instead be used a corrugated plate spring 27*e* which is slidable within the guide rail 27*b*, as illustrated in FIG. 15 and FIG. 16.

FIG. 15 is a cross sectional side view illustrating a pulley mechanism 27 using a corrugated plate spring 27*e* slidable within the guide rail 27*b* according to an eleventh embodiment of the present invention. FIG. 16 is a cross sectional view taken on line G—G in FIG. 15.

In FIG. 15 and FIG. 16, the corrugated plate spring 27*e* is arranged so as to slide on the guide rail 27*b* in place of the above-mentioned roller portion 27*c* (see FIG. 14).

In this case, the corrugated plate spring 27*e* also functions as the above-mentioned wheel portion 22, so the wheel portion 22 becomes unnecessary.

Embodiment 12

Although in the above-mentioned first embodiment, the impeller has a D-shaped cross section, it is formed into such a D-shaped configuration using a belt-like connecting portion associated with a drive shaft.

Figure 17:
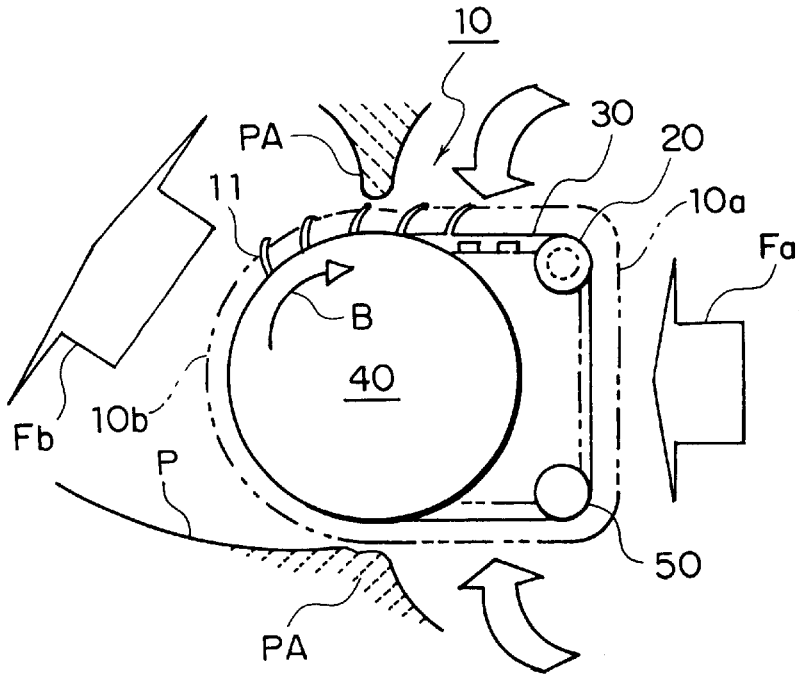
FIG. 17 is a cross sectional side view illustrating a twelfth embodiment of the present invention.

FIG. 17 is a cross sectional side view illustrating an impeller using a belt-like connecting portion according to a twelfth embodiment of the present invention, in which the same or like components as those in the aforementioned embodiments are identified by the same symbols while omitting a detailed description thereof.

Figure 18:
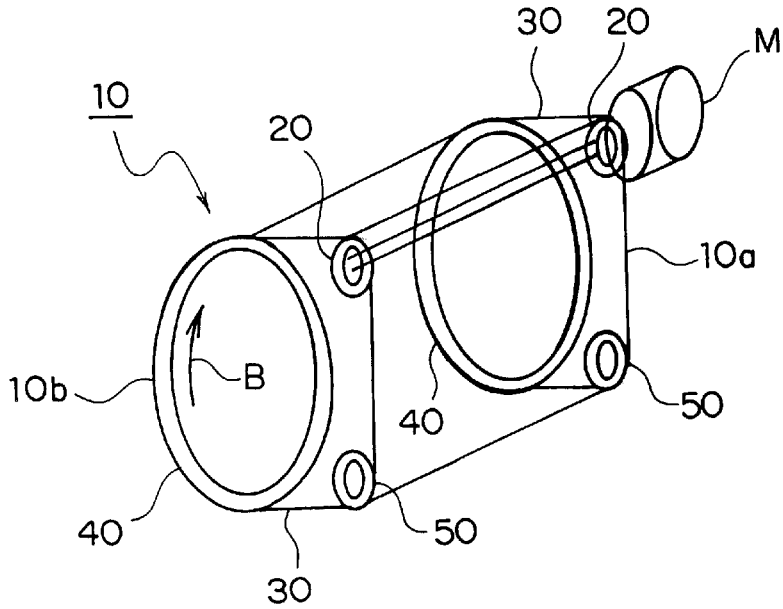
FIG. 18 is a perspective view schematically illustrating essential portions of a once-through pump according to a twelfth embodiment of the present invention.

FIG. 18 is a perspective view schematically illustrating the three-dimensional structure of a once-through blower according to the twelfth embodiment of the present invention.

In FIG. 17, an impeller 10 arranged in the flow passage P is driven to rotate in a direction indicated at arrow B around an axis of rotation oriented in a diametrical direction of the flow passage P.

In addition, the impeller 10 is provided on the outer periphery thereof with a plurality of vanes 11 (vane array) arranged at equal intervals.

The impeller 10 has a generally D-shaped cross sectional configuration including a straight portion 10*a* formed on a fluid inlet or suction side Fa and an arc portion 10*b* formed on a fluid outlet or discharge side Fb.

Moreover, the respective vanes 11 (arrayed vanes) forms a linear vane array in the straight portion 10*a* and an arc-shaped centrifugal vane array in the arc portion 10*b*.

A pair of partitions PA are protrudingly formed in the flow passage P in such a manner as to clamp the impeller 10 from the opposite sides thereof in a diametrical direction thereof.

The impeller 10 includes a drive shaft 20, at least one (e.g., two in the example illustrated in FIG. 17 and FIG. 18) belt-like connection portion 30 for connecting and arranging the arrayed respective vanes 11 with one another at substantially equal intervals, at least one (e.g., two in the example illustrated in FIG. 17 and FIG. 18) large wheel 40 for supporting the at least one belt-like connecting portion 30 from its inside, and at least one (e.g., four in the example illustrated in FIG. 17 and FIG. 18) small wheel 50 arranged at a location(s) apart from and opposite to the at least one large wheel 40 for supporting the at least one belt-like connecting portion 30 from its inside.

In FIG. 18, the drive shaft 20 is coupled with the rotation shaft of the motor M, so that the drive shaft 20 is driven to rotate by means of the motor M, thereby rotating the impeller 10 through two small wheels 50 connected with the drive shaft 20 together with two other small wheels 20 and two large wheels 40 while supporting two belt-like connecting portions 30 from their inside by means of these wheels 40, 50.

The array of vanes 11 (vane array) integrally arranged on the outer peripheries of the belt-like connecting portions 30 are urged into pressure contact with the outer peripheries of the large wheels 40 while being pulled by the drive shaft 20 through the small wheels 50. As a result, a linear array of vanes and a centrifugal array of vanes are compulsorily formed in the straight portion 10*a* and in the arc portion 10*b*, respectively.

That is, the small wheels 50 contribute to the formation of the linear vane array on the fluid inlet or suction side of the impeller 10, whereas the large wheels 40 contribute to the formation of the centrifugal vane array on the fluid outlet or discharge side of the impeller 10.

In this case, since the belt-like connecting portion 30 having the vanes 11 is compulsorily deformed to form a generally D-shaped cross sectional configuration, it is necessary to have two mutually contradictory functions, one being the easiness for the outer shape of the straight portion 10*a* (linear vane array) to collapse, the other being an elastic shape holding capability of holding the elastic outer shape of the arc portion 10*b* (arc-shaped centrifugal vane array).

Moreover, it is required that the part of each belt-like connecting portion 30 to which a rotational driving force (basically, pulling force) is transmitted from the drive shaft 20 has an elasticity just enough to withstand collapsing of the outer shape.

In view of these conditions, it has been experimentally determined that a belt mechanism comprising a combination of the belt-like connecting portions 30, the large wheels 40 and the small wheels 50, as depicted in FIG. 17 and FIG. 18, is the best solution.

Now, reference will be made to the air-blowing operation according to the twelfth embodiment of the present invention as illustrated in FIG. 17 and FIG. 18.

In the case of the centrifugal blower illustrated in FIG. 17, the space in the flow passage P between the straight portion 10*a* (inlet or suction side) pulled by the small wheels 50 and the semicircular arc portions 10*b* (outlet or discharge side) is separated and closed up by the pair of partitions PA protruded inwardly from the upper and lower walls of the flow passage P in FIG. 17.

Thus, the fluid (air stream) is sucked or drawn into the impeller 10 while being somewhat dragged in the rotational direction B in the linear vane array of the straight portion 10*a* shown to the right in FIG. 17, as indicated therein by an inlet or suction flow Fa.

Subsequently, in the centrifugal vane array of the arc portion 10*b* shown to the left in FIG. 17, the fluid F is discharged from the impeller 10 while similarly being somewhat dragged in the rotational direction B with a centrifugal force being applied thereto as indicated by an outlet or discharge flow Fb.

At this time, the fluids Fa and Fb are subjected to pressurization at two stages in the straight portion 10*a* and the arc portion 10*b*, whereby a pressure rise equal to or more than that with a centrifugal blower can be obtained unlike ordinary once-through blowers.

Moreover, the impeller 10 can be axially extended infinitely as long as the layout in the design permits, so that a desired amount of blast or flow rate can be obtained.

In addition, since the fluids Fa and Fb are pressurized while being dragged in the rotational direction B, as described above, if an outlet or discharge opening is directed in the rotational direction to a some extent in the arc portion 10*b* (centrifugal vane array) for example, the discharge flow Fb can be discharged or exited without any loss.

Embodiment 13

Although in the above-mentioned twelfth embodiment, any special consideration is not given to the suction opening and the discharge opening for the fluids Fa and Fb, respectively, stationary vanes may be provided in association with the linear vane array and the centrifugal vane array for offsetting a velocity component in the rotational direction B.

Figure 19:
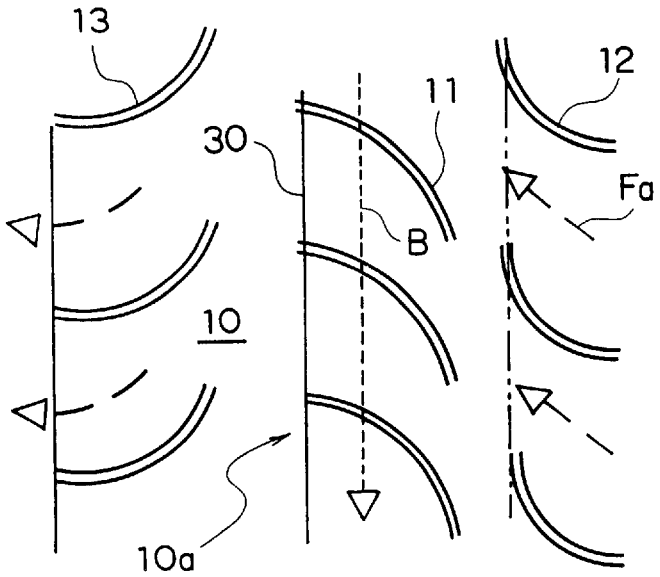
FIG. 19 is a side elevation illustrating, on an enlarged scale, a fluid inflow section according to a thirteenth embodiment of the present invention.
Figure 20:
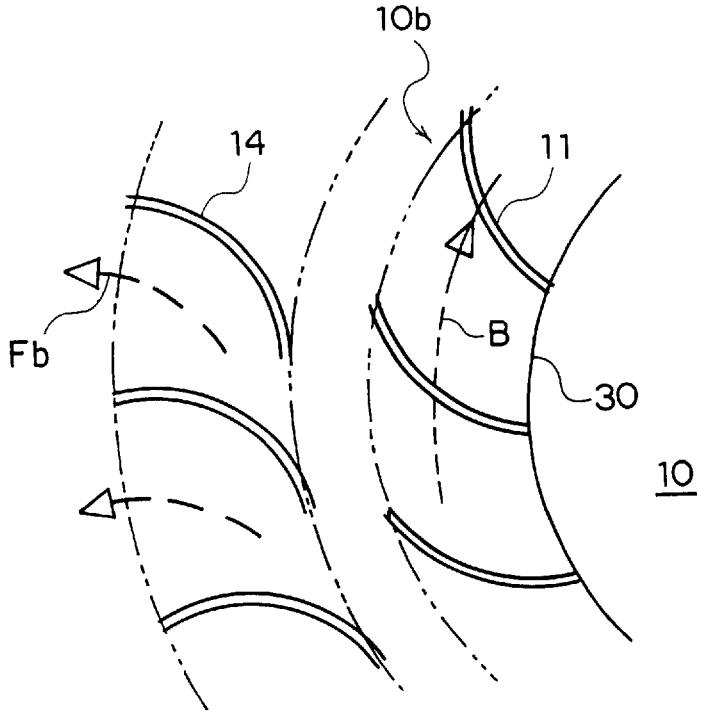
FIG. 20 is a side elevation illustrating, on an enlarged scale, a fluid discharge section according to the thirteenth embodiment of the present invention.

FIG. 19 and FIG. 20 are enlarged side elevations illustrating a vane array portion equipped with stationary vanes according to a thirteenth embodiment of the present invention.

In FIG. 19, a plurality of inlet stationary vanes 12 and a plurality of intermediate stationary vanes 13 are arranged on the upstream side and the downstream side, respectively, of the straight portion 10*a* (linear vane array).

Also, in FIG. 20, a plurality of outlet stationary vanes 14 are arranged on the downstream side of the arc portion 10*b* (centrifugal vane array) in FIG. 20.

First of all, in FIG. 19, the inlet stationary vanes 12 located on the upstream side of the straight portion 10*a* (linear vane array) creates a prewhirl to the suction flow Fa, which is immediately before entering the impeller 10, in a direction opposite the rotational direction B, as indicated by a broken line arrow, thereby offsetting the flow in the rotational direction.

Subsequently, the intermediate stationary vanes 13 in the impeller 10 recovers a rotational direction component of the fluid which has passed the vanes 11 of the linear array and flowed into the impeller 10, and creates a prewhirl to the centrifugal vane array in the delivery portion, as indicated by a broken line arrow.

Further, in FIG. 20, the outlet stationary vanes 14 located on the downstream side of the centrifugal vane array recovers a velocity component generated in the rotational direction B of the discharge flow Fb, as indicated by a broken line arrow in FIG. 20, thereby increasing the static pressure of the fluid which has been just discharged from the impeller 10 past the vanes 11 in the arc portion 10*b* (centrifugal vane array).

In this manner, the proper arrangement of the stationary vanes 12 through 14 serves to further improve stability in operation of the once-through blower and achieve a very large increase in pressure and the amount of air flow as well as reduction in noise.

Moreover, the rotating speed of the impeller 10 can be greatly raised, thereby further increasing the air-blowing efficiency and the blast pressure.

However, since there will be generated interference noise if the array of rotating vanes 11 and the stationary vanes 12 through 14 are located too close to each other, it is necessary to keep proper intervals or distances between the array of vanes 11 and the stationary vanes 12 through 14.

Embodiment 14

Figure 21:
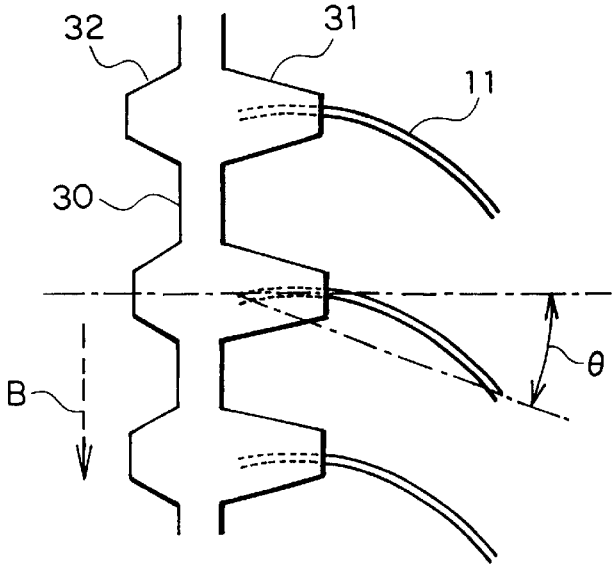
FIG. 21 is a side elevation illustrating a linear vane array according to a fourteenth embodiment of the present invention.
Figure 22:
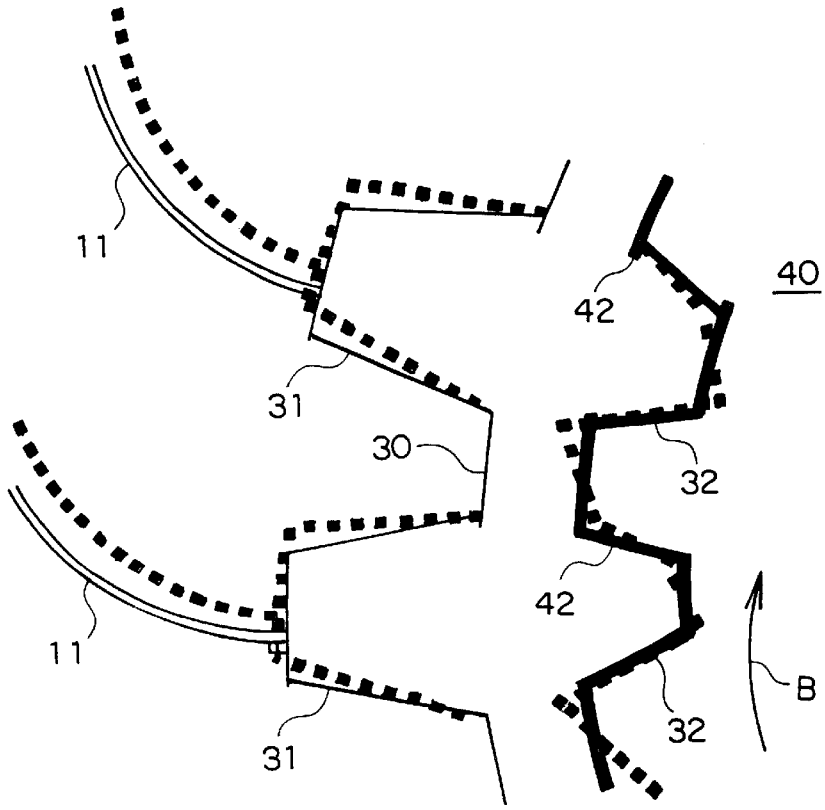
FIG. 22 is a side elevation illustrating a centrifugal vane array according to the fourteenth embodiment of the present invention.

Although in the above-mentioned twelfth embodiment, the detailed structure of the belt-like connecting portions 30 has not been referred to, a toothed belt may be used for each belt-like connecting portion 30, as illustrated in FIG. 21 and FIG. 22.

Moreover, the large wheels 40 may have the function of the drive shaft 20.

Generally, the main body of each belt-like connecting portion 30 may be an ordinary V belt or flat belt, but it is preferable to use a toothed belt in order to drive the axially elongated impeller 10 (see FIG. 18) without distorting it at its opposite ends.

The reason for this is as follows. That is, in case of the known once-through blower (see FIG. 25), the impeller 10 is integrally formed of a resin, and hence there is substantially no or little possibility of deformation and the above condition is irrelevant. However, in case of a belt type once-through blower as in the present invention (see FIG. 17 and FIG. 18), if there takes place no good synchronization in driving timing at the opposite axial ends of the impeller 10 and hence the belt-like connecting portions 30 (that is, non-synchronization of the large and small wheels 40, 50 at the opposite axial ends of the impeller 10), the impeller 10 would be caused to vibrate, and hence distortion of the impeller 10 at the opposite ends thereof must be suppressed by the use of the toothed belts.

Hereinafter, a once-through blower using a pair of toothed belts according to a fourteenth embodiment of the present invention will be described in detail while referring to FIG. 21 and FIG. 22.

FIG. 21 and FIG. 22 are enlarged side elevations illustrating a vane array part of a belt-like connecting portion according to the fourteenth embodiment of the present invention.

In FIG. 21 and FIG. 22, each belt-like connecting portion 30 has a plurality of outer periphery support sections 31 arranged at equal intervals along the rotational direction B of the impeller 10.

The respective vanes 11 (vane array) of the impeller 10 are fixed to the outer periphery support sections 31 of each belt-like connecting portion 30, and they are each arranged to maintain a constant vane angle θ.

In addition, each belt-like connecting portion 30 is formed on the inner peripheral side thereof with inner peripheral teeth 32 which are arranged at equal intervals along the rotational direction B of the impeller 10.

The inner peripheral teeth 32 are formed with the same pitch as that of the outer periphery support sections 31, and forms an integral quadrilateral together with the outer periphery support sections 31.

On the other hand, each of the large wheels 40 includes a plurality of outer peripheral teeth 42 arranged at equal intervals along the rotational direction B, as shown in FIG. 22.

As illustrated, the outer peripheral teeth 42 of each large wheel 40 are formed so as to be engageable with the inner peripheral teeth 32 of the corresponding belt-like connecting portion 30.

The outer peripheral teeth 42 and the inner peripheral teeth 32 are tuned to support dimensions of the cross sectional shape of the impeller 10 at a plurality of locations including its opposite ends so as to prevent the occurrence of distortion of the vanes 11 at the opposite axial ends of the impeller 10.

Moreover, the outer periphery support sections 31 and the inner peripheral teeth 32 of each belt-like connecting portion 30 has a quardrilateral cross sectional shape which can be deformed in such a manner as indicated by broken lines in FIG. 22.

Deforming the cross sectional shape of the outer periphery support sections 31 (and the inner peripheral teeth 32) can be implemented by forming the outer peripheral teeth 42 of each large wheel 40 into slant embossed or padding shapes (i.e., trapezoidal cross sectional shapes) inclined with respect to the rotational direction B (see broken lines in FIG. 22).

With the structures as shown in FIG. 21 and FIG. 22, the vanes 11 are fixedly secured to the outer periphery support sections 31 of each belt-like connecting portion 30 located on the opposed side of the inner peripheral teeth 32 in such a manner that they can always hold a constant vane angle θ irrespective of the load of the fluid.

Moreover, it goes without saying that the outer periphery support sections 31 of each belt-like connecting portion 30 have a degree of hardness capable of maintaining the constant vane angle θ even in the arc portion 10*b* in which each belt-like connecting portion 30 is curved.

Generally, the outer periphery support sections 31 are made of rubber materials similar to those used for the main belt body, but they may instead be made of resin materials, or metal pieces engagingly attached to the main belt body may be used for the same purpose.

In addition, though rubber materials are used for the main belt body, they may be combined with reinforcing materials such as cloths, fibers, metal wires or the like so as to further increase the strength thereof.

Furthermore, if the outer peripheral teeth 42 of the large wheel 40 are formed into the slant embossed or padding shapes, as shown by the broken lines in FIG. 22, the inner peripheral teeth 32 of each belt-like connecting portion 30 can follow the slant embossed or padding shapes so that they are inclined together with the outer periphery support sections 31, thereby making it possible to deform the outer periphery support sections 31 in a manner as inclined toward the rotational direction B.

As a consequence, the vane angle θ in the straight portion 10*a* and the arc portion 10*b* is not fixed to a constant value, so it is possible to set the vane angle θ in the arc portion 10*b* engaging the outer peripheral teeth 42 of the large wheels 40 to be greater than that in the straight portion 10*a*.

That is, when the inner peripheral teeth 32 of the belt-like connecting portions 30 is placed into engagement with the complementarily shaped grooves (trapezoidally toothed grooves) of the outer peripheral teeth 42 of the corresponding large wheels 40, the inner peripheral teeth 32 and the outer periphery support sections 31 of the belt-like connecting portions 30 fall or incline forward in the rotational direction B along the trapezoidally toothed grooves of the large wheels 40, thus resulting in an increase in the vane angle θ in the arc portion 10*b*.

At this time, the inner peripheral teeth 32 of the belt-like connecting portions 30 can be shaped into the slant embossed or padding configurations so as to conform to the shape of the outer peripheral teeth 42 of the large wheels 40, whereby the cross sectional shapes of the inner peripheral teeth 32 of the belt-like connecting portions 30 can be smoothly deformed while following the outer peripheral teeth 42 of the large wheels 40.

In general, since it is preferable to set the vane angle θ in the arc portion 10*b* greater than that in the straight portion 10*a*, the vane angle θ in the arc portion 10*b* is set in advance to a smaller value matching the vane angle θ in the straight portion 10*a*, and by providing the above-mentioned deformation structure to the belt-like connecting portions 30, the vane angle θ in the arc portion 10*b* at the locations of the large wheels 40 is then set greater than the initially set value.

Moreover, in cases where the belt-like connecting portions 30 are caused to deform by means of the corresponding large wheels 40 having the trapezoidally toothed grooves in this manner, it is preferred that the large wheels 40 be integrally coupled with the drive shaft 20 in alignment therewith so as to have a driving function as well. On the other hand, in this case, any of the small wheels 50 are not coupled with the drive shaft 20 and they are provided with no toothed groove but merely have the pulley function alone for a V belt.

Moreover, though the inner peripheral teeth 32 of the belt-like connecting portions 30 may have ordinary flat or square heads (crests), it is preferred that they be formed into slant embossed or padding shapes similar to those of the the outer peripheral teeth 42 of the large wheels 40 as referred to above, thus making it possible to further improve the deformation effect.

In addition, the toothed groove structure (parallel shape) of at least one of the inner peripheral teeth 32 of the belt-like connecting portions 30 and the outer peripheral teeth 42 of the large wheels 40 can be modified to change the vane angle θ in the centrifugal vane array, and hence to this end, only the inner peripheral teeth 32 of the belt-like connecting portions 30 may be formed into the slant embossed or padding shapes.

Further, although in the above-mentioned twelfth through fourteenth embodiments, the belt-like connecting portions 30 are provided on the opposite axial ends of the impeller 10, as illustrated in FIG. 18, two or more belt-like connecting portions may be provided at a plurality of arbitrary locations as desired.

In this case, too, it is needless to say that the inner peripheral teeth 32 of the respective belt-like connecting portions 30 and the outer peripheral teeth 42 of the large wheels 40 are respectively tuned to support dimensions of the cross sectional shape of the impeller 10 so as to prevent the occurrence of distortion of the vanes 11 at the opposite axial ends of the impeller 10.

Embodiment 15

Although in the above-mentioned twelfth embodiment, the cross sectional shape of the impeller 10 is formed into a generally D-shaped configuration, it may be of a substantially spindle-shaped configuration.

Figure 23:
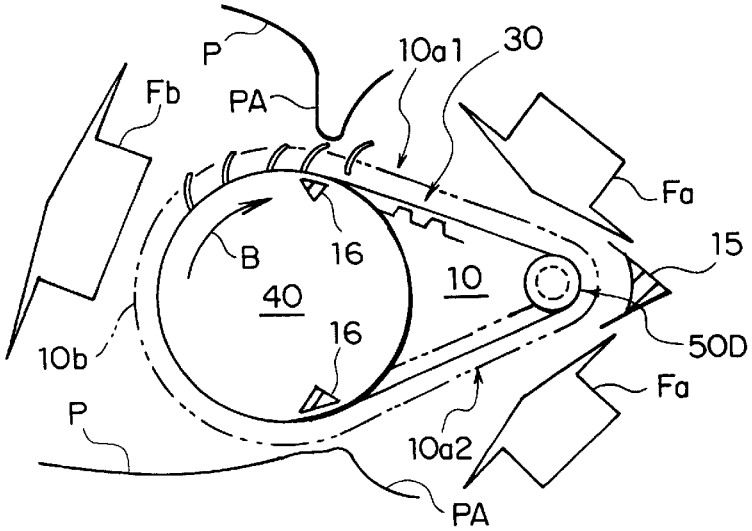
FIG. 23 is a cross sectional side view illustrating a fifteenth embodiment of the present invention.
Figure 24:
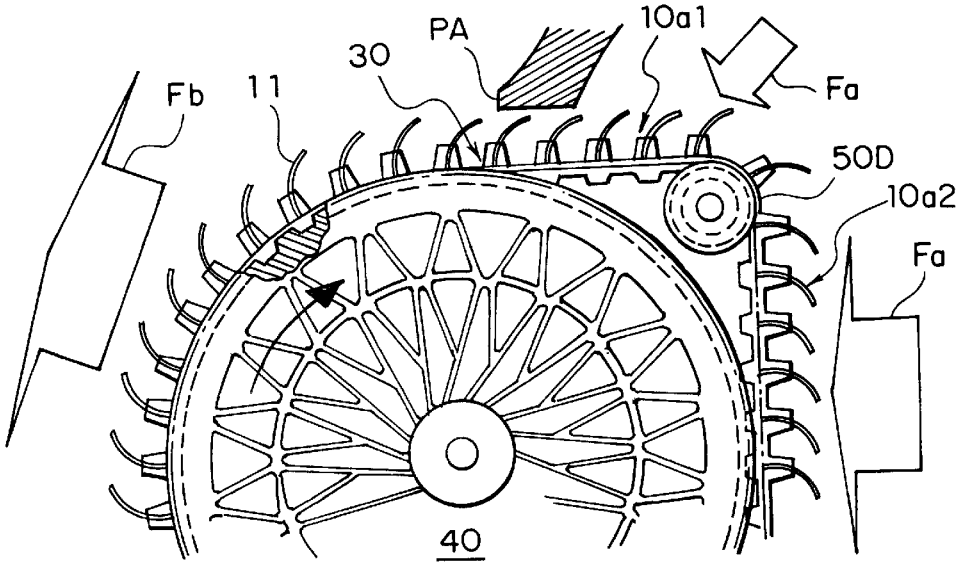
FIG. 24 is a cross sectional side view illustrating, on an enlarged scale, once-through pump (once-through blower) according to the fifteenth embodiment of the present invention.

FIG. 23 and FIG. 24 are cross sectional side views illustrating a once-through blower having an impeller 10 of a substantially spindle-shaped cross sectional configuration according to a fifteenth embodiment of the present invention illustrating a shape of the impeller 10, in which the same or corresponding parts or elements as those in the aforementioned embodiments are identified by the same symbols while omitting a detailed description thereof.

In FIG. 23 and FIG. 24, a small wheel 50D is integrally formed with the above-mentioned drive shaft 20 (see FIG. 16), while omitting the drive shaft 20.

The small wheel 50D acts to pull a belt-like connecting portion 30 in opposition to a large wheel 40 so as to form a pair of straight portions 10*a*1 and 10*a*2 (linear vane arrays) with the small wheel 50D located as the center.

FIG. 23 and FIG. 24 illustrate an example including the single large wheel 40 and the single small wheel 50D.

In this manner, the cross sectional shape of the impeller 10 comprising the belt-like connecting portion 30 is formed into a substantially spindle-shaped configuration including the arc portion 10*b*, which is formed by a part of the belt-like connecting portion 30 wrapped around the large wheel 40, and the straight portions 10*a*1 and 10*a*2, which are formed by the parts of the belt-like connecting portion 30 disposed between the large wheel 40 and the small wheel 50D that is arranged in opposition to the large wheel 40.

Here, the cross sectional shape of the impeller 10 is formed into the spindle-shaped configuration, but it may be of any other arbitrary configuration if those parts of the belt-like connecting portion 30 arranged in opposition to the arc portion 10*b* can perform linear motion.

Incidentally, the outer peripheral teeth (toothed grooves) for driving the belt-like connecting portion 30 may be provided on the small wheel 50D which acts as a drive shaft, and hence, in this case, the small wheel 50D may be coupled with the rotating shaft of a motor M (see FIG. 18) so as to act as a drive shaft for synchronized rotation, whereas the large wheel 40 may comprise a simple guide roller having no toothed groove.

However, in cases where the vane angle θ in the arc portion 10*b* is controlled to differ from the vane angle θ in the straight portions 10*a*1 and 10*a*2 as described before, the large wheel 40 functions as a drive shaft having toothed grooves.

In FIG. 23 and FIG. 24, the belt-like connecting portion 30 is pulled by the small wheel 50D to form the straight portions 10*a*1 and 10*a*2 (linear vane arrays), and it is supported from its inside by the large wheel 10 to form the arc part 10*b* (centrifugal vane array).

In this manner, by pulling the belt-like connecting portion 30 by means of the single small wheel 50D, it is possible to form the spindle-shaped configuration (including two straight vane arrays 10*a*1, 10*a*2), unlike the case in which the D-shaped configuration (including three linear vane arrays) is formed by the use of two small wheels (i.e., one drive shaft 20 and one small wheel 50) as described before with reference to FIG. 17.

Moreover, as shown in FIG. 23 and FIG. 24, the large wheel 40 is arranged such that it is placed in contact at its right side with the linear vane arrays 10*a*1 and 10*a*2. As a result, slackening (or vibration) of the straight portions 10*a*1 and 10*a*2 can be suppressed by using parts of the large wheel 40.

However, such a construction is not essential, and in cases where the above vibration might be caused, a damper guide may be provided for each of the straight portions 10*a*1 and 10*a*2 so as to suppress such vibration.

In this case, there are the following effects or merits as compared with the case in which the impeller 10 is formed into the D-shaped configuration as described with reference to FIG. 17. That is, the occupation ratio of the straight portions 10*a*1 and 10*a*2 to the entire circumferential length of the impeller 10 increases, and the length of the arc portion 10*b* increases more than the length of a semicircle (π radian).

In this case, however, since incoming streams of the suction fluid Fa are forced to flow in such directions as to mutually impinge against one another at the location of the small wheel 50D, it is necessary to avoid that the small wheel 50D is arranged too far from the large wheel 40 or the outside diameter of the small wheel 50D is reduced excessively, resulting in too small a vertical angle included by the straight portions 10*a*1 and 10*a*2.

Moreover, in this case, the linear motion of the belt-like connecting portion 30 is distorted in the part of the small wheel 50D, which can be regarded as a centrifugal blower that is locally performing a circular motion. Thus, it is desired to take an appropriate measure for preventing the action of reverse flow.

For instance, the outside diameter of the central shaft of the small wheel 50D may be increased so as to block the inflow of fluid from the vicinity of the small wheel 50D, or a barrier wall segment 15 (see FIG. 23) may be provided for preventing the fluid from flowing therein.

In addition, in order to further increase the sealing effect of a partition PA for separating a suction flow Fa and a discharge flow Fb from each other, an auxiliary partition segment 16 (see FIG. 23) for separation may be arranged inside the large wheel 40 which is disposed in confrontation with the partition PA.

In the above-mentioned twelfth through fifteenth embodiments, for a mechanism of the belt-like connecting portion 30, there has been used at least one toothed belt, which is most simple in construction, reliable and stable in operation, but another suitable element such as a V belt, a flat belt, a chain or the like can be arbitrarily employed as long as the timings for driving or feeding the impeller at its opposite ends, which are arranged in the axial direction of the rotating shaft of the once-through blower, can be synchronized with each other.

Although the present invention has been shown and described herein while taking the once-through blower as a typical example, it goes without saying that the present invention is applicable to once-through pumps for driving other fluids, powders or the like.

While the invention has been described in terms of preferred embodiments, those skilled in the art will recognize that the invention can be practiced with modifications within the spirit and scope of the appended claims.

What is claimed is:

1. A once-through pump for accelerating fluid in a flow passage while passing said fluid through said flow passage, said pump comprising:

an impeller rotatably supported in said flow passage;

a plurality of vanes provided on the outer periphery of said impeller;

a drive shaft for driving said impeller to rotate;

wherein said impeller has a substantially D-shaped cross sectional configuration with a suction side, at which said fluid is sucked into said impeller, being formed into a straight portion, and each of said vanes has a positive vane angle with respect to a fluid advancing direction in said straight portion.

2. The once-through pump according to claim 1, wherein said impeller comprises:

a curvable wheel portion positioned at a side end face of an outer periphery of said impeller; and straight portion forming means for forming said straight portion in a part of said wheel portion;

wherein said straight portion forming means comprises a guide plate member of a substantially D-shaped configuration disposed inside said wheel portion; and said wheel portion comprises a chain member which is slidable along an outer periphery of said guide plate member, said wheel portion being driven to rotate by means of a drive shaft which is in engagement with said chain member.

3. A once through pump for accelerating fluid in a fluid passage, said pump compromising:

An impeller provided in said flow passage and having an axis of rotation arranged in a diametrical direction of said flow passage;

a vane array including a plurality of vanes provided on an outer periphery of said impeller; and a drive shaft for driving said impeller to rotate; wherein said impeller comprises:

a belt-like connecting portion for connecting and arranging said respective vanes of said vane array with one another at substantially equal intervals;

a single large wheel for supporting said belt-like connecting portion from its inside; and at least one small wheel disposed at a location in opposition to and apart from said large wheel for supporting said belt-like connecting portion from its inside;

wherein said vane array arranged integrally with said belt-like connecting portion includes an arc-shaped centrifugal vane array and a linear vane array compulsorily formed by said large wheel and said at least one small wheel, and said small wheel forms said linear vane array at a suction side of said fluid with respect to said impeller, and said large wheel forms said centrifugal vane array at a discharge side of said fluid with respect to said impeller.

4. The once-through pump according to claim 3, wherein said drive shaft together with said at least one small wheel forms said linear vane array, and said impeller has a substantially D-shaped cross sectional configuration.

5. The once-through pump according to claim 3, wherein said small wheel is formed integrally with said drive shaft to provide a pair of linear vane arrays with said small wheel arranged at their center, and said impeller has a cross sectional shape formed into a substantially spindle-shaped configuration.

6. The once-through pump according to claim 3, wherein said belt-like connecting portion has a plurality of outer periphery support sections arranged at equal intervals along a rotational direction of said impeller, and said respective vanes of said vane array are fixedly secured to said outer periphery support sections, and each arranged so as to maintain a constant vane angle.

7. The once-through pump according to claim 6, wherein said large wheel has a plurality of outer peripheral teeth arranged at equal intervals along a rotational direction of said large wheel, and said belt-like connecting portion has a plurality of inner peripheral teeth arranged at equal intervals in a rotational direction of said impeller so as to engage said outer peripheral teeth of said large wheel, and said outer peripheral teeth and said inner peripheral teeth are tuned to support dimensions of the cross sectional shape of said impeller at a plurality of locations including opposite axial ends of said impeller for preventing occurrence of distortion of said vanes at said opposite axial ends of said impeller.

8. The once-through pump according to claim 7, wherein said inner peripheral teeth of said belt-like connecting portion are formed integrally with said outer periphery support sections at a same pitch at which said outer periphery support sections are arranged.

9. The once-through pump according to claim 8, wherein each of said inner peripheral teeth of said belt-like connecting portion and said outer periphery support sections has a deformable quadrilateral cross sectional shape, and said outer peripheral teeth of said large wheel are formed into slant embossed shapes with respect to a rotational direction of said impeller and said large wheel, so that said quadrilateral cross sectional shape can be deformed in a direction to increase the vane angle of each of said vanes.

10. The once-through pump according to claim 8, wherein said large wheel is formed integrally with said drive shaft.

* * * * *